US009201326B2

(12) United States Patent
Yoshida et al.

(10) Patent No.: US 9,201,326 B2
(45) Date of Patent: Dec. 1, 2015

(54) TONER, DEVELOPER AND IMAGE FORMING APPARATUS

(71) Applicants: Ryuuta Yoshida, Miyagi (JP); Takahiro Honda, Shizuoka (JP); Junichi Awamura, Shizuoka (JP); Osamu Uchinokura, Shizuoka (JP); Masaki Watanabe, Shizuoka (JP); Daisuke Inoue, Shizuoka (JP); Tomoki Murayama, Miyagi (JP); Mamoru Hozumi, Miyagi (JP)

(72) Inventors: Ryuuta Yoshida, Miyagi (JP); Takahiro Honda, Shizuoka (JP); Junichi Awamura, Shizuoka (JP); Osamu Uchinokura, Shizuoka (JP); Masaki Watanabe, Shizuoka (JP); Daisuke Inoue, Shizuoka (JP); Tomoki Murayama, Miyagi (JP); Mamoru Hozumi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 29 days.

(21) Appl. No.: 13/729,926

(22) Filed: Dec. 28, 2012

(65) Prior Publication Data

US 2013/0196260 A1 Aug. 1, 2013

(30) Foreign Application Priority Data

Jan. 31, 2012 (JP) ..... 2012-018256

(51) Int. Cl.
*G03G 9/087* (2006.01)
*G03G 9/08* (2006.01)

(52) U.S. Cl.
CPC ..... *G03G 9/08755* (2013.01); *G03G 9/0802* (2013.01); *G03G 9/08782* (2013.01); *G03G 9/08797* (2013.01)

(58) Field of Classification Search
USPC ..... 430/123.52, 123.53, 109.4, 109.1, 430/108.1
See application file for complete search history.

(56) References Cited

U.S. PATENT DOCUMENTS

| | | | | |
|---|---|---|---|---|
| 5,635,325 | A * | 6/1997 | Inaba et al. | 430/108.4 |
| 2006/0216630 | A1 | 9/2006 | Ninomiya et al. | |
| 2009/0181317 | A1* | 7/2009 | Moriya | 430/109.4 |
| 2010/0316948 | A1* | 12/2010 | Sakaguchi et al. | 430/109.4 |
| 2011/0076607 | A1 | 3/2011 | Sugimoto et al. | |
| 2011/0086305 | A1 | 4/2011 | Watanabe et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0200929 | A1 | 8/2011 | Karato et al. | |
| 2011/0223532 | A1* | 9/2011 | Sugimoto et al. | 430/109.4 |
| 2011/0236812 | A1* | 9/2011 | Ishihara et al. | 430/105 |
| 2011/0262853 | A1 | 10/2011 | Watanabe et al. | |
| 2011/0281214 | A1 | 11/2011 | Kuroyama | |
| 2011/0294058 | A1 | 12/2011 | Shiba et al. | |
| 2011/0305986 | A1 | 12/2011 | Ogawa et al. | |
| 2011/0318053 | A1 | 12/2011 | Yamashita et al. | |
| 2012/0021347 | A1 | 1/2012 | Shimota et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |
| 2012/0122027 | A1 | 5/2012 | Watanabe et al. | |
| 2012/0219896 | A1 | 8/2012 | Asahina et al. | |
| 2012/0237869 | A1 | 9/2012 | Chiba et al. | |
| 2012/0237870 | A1 | 9/2012 | Watanabe et al. | |
| 2012/0264043 | A1 | 10/2012 | Watanabe et al. | |

FOREIGN PATENT DOCUMENTS

| | | | |
|---|---|---|---|
| EP | 0974871 | A1 | 1/2000 |
| JP | 08-050368 | | 2/1996 |
| JP | 2000-039738 | | 2/2000 |
| JP | 2002-108018 | | 4/2002 |
| JP | 2002-214831 | | 7/2002 |
| JP | 2003-050478 | | 2/2003 |
| JP | 2003-167384 | | 6/2003 |
| JP | 2003-280271 | | 10/2003 |
| JP | 2006-267735 | A | 10/2006 |
| JP | 2006-276044 | | 10/2006 |
| JP | 2006-293273 | A | 10/2006 |
| JP | 2007-079329 | | 3/2007 |
| JP | 2007-127920 | | 5/2007 |
| JP | 2007-148085 | | 6/2007 |
| JP | 2007-334188 | | 12/2007 |
| JP | 2011-033823 | A | 2/2011 |
| JP | 2011-059261 | | 3/2011 |
| JP | 2011-123483 | A | 6/2011 |
| JP | 2011-237801 | | 11/2011 |

OTHER PUBLICATIONS

Official Action in JP Patent Application No. 2012-018256 dated Jun. 8, 2015 with English Translation.

* cited by examiner

*Primary Examiner* — Thorl Chea
(74) *Attorney, Agent, or Firm* — Oblon, McClelland, Maier & Neustadt, L.L.P.

(57) ABSTRACT

A toner including: a binder resin containing a non-crystalline resin and a crystalline resin; a colorant; and, a releasing agent, wherein the releasing agent has a melting point of 55° C. to 80° C., and wherein the toner satisfies the following Expressions 1 and 2: (Expression 1): 20,000 Pa·s≤G1≤50,000 Pa·s; and (Expression 2): (G4/G2)/(G3/G1) 1.00, where G1 is a storage modulus, G2 is a loss modulus, G3 is a storage modulus and G4 is a loss modulus, and the storage modulus G1 and the loss modulus G2 are measured at 80° C. when the toner is heated from 70° C. to 150° C. and the storage modulus G3 and the loss modulus G4 are measured at 80° C. when the toner heated to 150° C. is cooled to 70° C.

6 Claims, 2 Drawing Sheets

TONER, DEVELOPER AND IMAGE FORMING APPARATUS

BACKGROUND OF THE INVENTION

1. Field of the Invention

The present invention relates to: a toner suitably used in, for example, electrophotographic methods, electrostatic recording methods and electrostatic printing methods; a developer containing the toner; and an image forming apparatus using the toner.

2. Description of the Related Art

As fixing methods used in dry developing methods, heating heat-roller methods have widely been used by virtue of their energy efficiency.

In order to achieve energy saving by decreasing the fixing temperatures of toners, heat energy applied to toners upon fixation tends to be reduced in recent years.

According to the DSM (Demand-side Management) program of International Energy Agency (IEA) in the 1999 fiscal year, next-generation copiers whose copies per minute (CPM) is 30 or more are required to have such performances that they have to have a waiting time of 10 sec or shorter during which the consumption power is 10 Watt to 30 Watt (which is varied with the copies per minute). Therefore, achieving energy saving has become a quite important issue.

One method proposed for achieving energy saving is making toners melt at low temperatures to thereby decrease their fixing temperature upon use.

In one method for producing such a toner that can be fixed at low temperatures, a binder resin is made to contain a specific non-olefin crystalline polymer or crystalline polyester having a glass transition temperature showing sharp melt property. Also, studies have widely been conducted on methods of achieving both desired low-temperature fixing property and desired heat resistance storage stability by controlling the viscoelasticity and the thermal characteristics of toners.

For example, there has been proposed a toner which contains: a binder resin containing a crystalline resin (especially a crystalline polyester resin) having at least one melting point; and a resin having a water contact angle smaller than that of the crystalline resin (see Japanese Patent Application Laid-Open (JP-A) No. 2002-108018). This proposal describes that improvement in low-temperature fixing property is achieved.

Also, there has been described an image forming method in which image formation is performed using a toner which contains a binder resin containing a crystalline polyester resin as a main ingredient, whereby the low-temperature fixing property of the toner is improved (see JP-A No. 2002-214831).

Furthermore, there has been a proposal referring to the following: a toner which contains as binder resins a crystalline resin and a non-crystalline resin able to at least partially be in a compatible state is decreased in glass transition temperature (Tg) and incorporation of such resins is effective for improving the low-temperature fixing property of the toner; a degree of reduction in glass transition temperature (Tg) of toner is varied with a combination of resins forming a binder resin, and there are combinations with which the low-temperature fixing property can be improved; and hot offset resistance is good and both excellent toner blocking resistance and excellent low-temperature fixing property are achieved (see JP-A No. 2006-276044).

Also, high color-developability has been required for the recent full-color toners for increasing the quality of images. Vivid color development of the fixed toner requires high glossiness of images. In one method of increasing the glossiness of images, spreading property of toner upon fixation is increased by decreasing the viscosity of melted toner, and the surface of an image is more smoothed to increase its glossiness. For example, there has been a proposal of using a crosslinked aliphatic alcohol polyester containing gel and a non-crosslinked aromatic alcohol polyester free of gel as binder resins of a toner in order to achieve both desired fixing property and desired heat resistance property (see JP-A No. 2000-039738).

Also, there has been a proposal of using as binder resins polyester resins having different flow softening temperatures in combination in order to improve fixing property, glossiness and melt-fusion resistance (see JP-A No. 2007-148085).

Also, there has been a proposal of defining a toner containing a polyester resin as a binder resin in terms of the molecular weights of its tetrahydrofuran (THF) soluble matter and its THF insoluble matter in order to achieve both desired low-temperature fixing property and offset resistance (see JP-A No. 2003-280271).

However, the toners of these proposals pursuing to desired low-temperature fixing property may have a problem of sticking between fixed images.

Copiers have been required for high image quality and also for high-speed fixing for improvement in productivity. When fixation is performed at a high speed and many times, fixed paper sheets are discharged before they do not sufficiently release their heat applied thereto upon fixation. That is, a large number of the paper sheets are stacked on top of one another at a stacking portion while carrying a certain degree of heat. In this state, each paper sheet receives intense pressure while keeping heat. Many of toners improved in low-temperature fixing property have a melting property at low temperatures. Thus, paper sheets where such toners have been fixed are stacked on top of one another while the toners are being molten in some degree, causing sticking between paper sheets and image failures such image peeling. Meanwhile, decreasing the viscosity of molten toner to improve its glossiness further raises risk of formation of abnormal images. When cooling is employed as a method for preventing formation of abnormal images, energy for cooling paper sheets is required. As a result, even if energy saving in fixation can be achieved, the total energy saving of the system should be impaired.

In view of the above, in order to prevent formation of abnormal images by focusing on a toner only, JP-A No. 2003-050478 or other documents define a toner such that its DSC curve measured through differential scanning calorimetry (DSC) has an absorption peak in a range of 50° C. to 100° C. in the first heating, and its peak area in the second heating is reduced to ⅓ the endothermic peak area in the first heating. In this toner, the crystalline compound and the binder resin becomes in a compatible state, suppressing sticking between images caused by the crystalline compound.

According to JP-A No. 2007-079329, by using a nucleating agent for a crystalline resin having a freezing point higher than the melting point of a releasing agent, the nucleating agent and the releasing agent are made to be in a non-compatible state, promoting recrystallization of the crystalline resin to improve storageability of a toner and images. This toner, however, is insufficient in achievement of both desired low-temperature fixing property and desired heat resistance storage stability.

Also, JP-A No. 2007-127920 defines the molecular size of a binder resin to make small the difference in molecular size between the binder resin and the releasing agent. With this definition, the releasing agent exudes uniformly and quickly upon fixation and can suppress sticking between discharged paper sheets.

Any of these prior art documents, however, is still insufficient in both sufficient low-temperature fixing property and high heat resistance storage stability.

SUMMARY OF THE INVENTION

The present invention aims to provide a toner which exhibits high heat resistance storage stability without impairment in low-temperature fixing property, which prevents sticking between discharged paper sheets even in high-speed fixing systems, and which achieves a high degree of energy saving.

Means for solving the above existing problems are as follows.

A toner of the present invention includes: a binder resin containing a non-crystalline resin and a crystalline resin; a colorant; and, a releasing agent, wherein the releasing agent has a melting point of 55° C. to 80° C., and wherein the toner satisfies the following Expressions 1 and 2:

$$20{,}000\ \text{Pa·s} \leq G1 \leq 50{,}000\ \text{Pa·s; and} \quad \text{(Expression 1)}$$

$$(G4/G2)/(G3/G1) \leq 1.00, \quad \text{(Expression 2)}$$

where G1 is a storage modulus, G2 is a loss modulus, G3 is a storage modulus and G4 is a loss modulus, and the storage modulus G1 and the loss modulus G2 are measured at 80° C. when the toner is heated from 70° C. to 150° C. and the storage modulus G3 and the loss modulus G4 are measured at 80° C. when the toner heated to 150° C. is cooled to 70° C.

The present invention can provide a toner which exhibits high heat resistance storage stability without impairment in low-temperature fixing property, which prevents sticking between discharged paper sheets even in high-speed fixing systems, and which achieves a high degree of energy saving. The toner of the present invention can solve the above existing problems and achieve the above objects.

DETAILED DESCRIPTION OF THE INVENTION (Toner)

Figure 1:
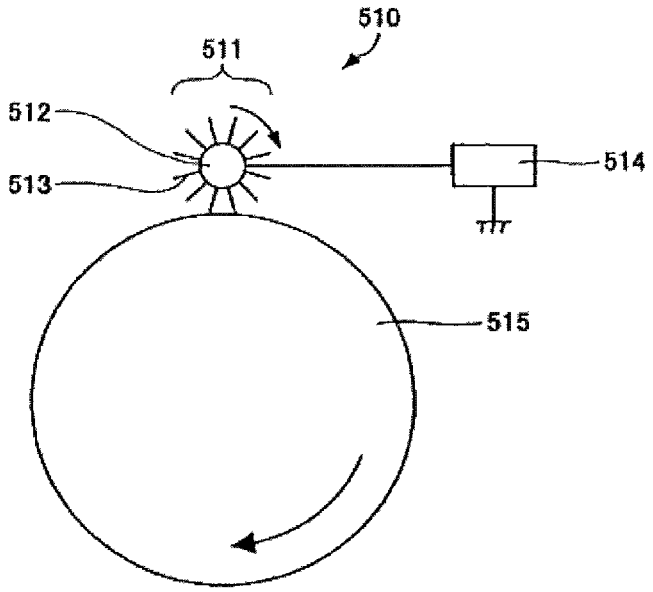
FIG. 1 illustrates one exemplary brush charging unit in an image forming apparatus of the present invention.

A toner of the present invention contains: a binder resin containing a non-crystalline resin and a crystalline resin; a colorant and a releasing agent; and, if necessary, further contains other ingredients.

The viscoelasticity (storage modulus and loss modulus) of the toner is greatly concerned with, for example, its fixability and heat resistance storage stability. The storage modulus of the toner is a physical property indicating the degree of elasticity like a rubber, and the loss modulus of the toner indicates the degree of viscosity like a dashpot.

In the present invention, the storage modulus G1 and the loss modulus G2 measured at 80° C. when the toner is heated from 70° C. to 150° C., and the storage modulus G3 and the loss modulus G4 measured at 80° C. when the toner heated to 150° C. is cooled to 70° C. satisfy a predetermined relation described below.

First, the storage modulus G1 at 80° C. in the heating of the toner has to satisfy the following (Expression 1), preferably satisfies the following (Expression 1a).

$$20{,}000\ \text{Pa·s} \leq G1 \leq 50{,}000\ \text{Pa·s} \quad \text{(Expression 1)}$$

$$30{,}000\ \text{Pa·s} \leq G1 \leq 46{,}000\ \text{Pa·s} \quad \text{(Expression 1a)}$$

The storage modulus G1 at 80° C. in the heating the toner is a characteristic value that is well correlated with storageability during storage of the toner. When the storage modulus G1 is less than 20,000 Pa·s, the viscoelasticity of the toner is insufficient, so that the toner is softened easily and its heat resistance storage stability becomes insufficient. Whereas when the storage modulus G1 is more than 50,000 Pa·s, the viscoelasticity of the toner is too high, excessively increasing the force acting to keep the structure of toner particles having received heat and pressure at the initial stage of fixing. As a result, the toner is difficult to melt and its low-temperature fixing property may be degraded.

Next, sticking between discharged paper sheets occurs in the process where the toner is repeatedly heated upon fixation to form toner images which are then superposed on top of one another and cooled. Therefore, it is important for the toner given a heat history once to recover its viscoelasticity when it is cooled. Then, the storage modulus G1 and the loss modulus G2 at 80° C. in the heating of the toner and the storage modulus G3 and the loss modulus G4 at 80° C. in the cooling of the toner have to satisfy the following (Expression 2), preferably satisfy (Expression 2a).

$$(G4/G2)/(G3/G1) \leq 1.00 \quad \text{(Expression 2)}$$

$$(G4/G2)/(G3/G1) \leq 0.92 \quad \text{(Expression 2a)}$$

When the toner satisfies the above (Expression 2), the recovery of elasticity is larger than that of viscosity. Thus, even in a situation where sticking between discharged paper sheets can occur, the toner predominantly restores like a rubber and can prevent sticking between discharged paper sheets. When the (G4/G2)/(G3/G1) is greater than 1.00, the recovery of viscosity is larger, so that the molten toner does plastic deformation due to heat and pressure when the paper sheets are stacked on top of one another, potentially inducing sticking between discharged paper sheets.

The toner of the present invention has to satisfy the relation about its viscoelasticity, and more preferably satisfy the following relation about its viscoelasticity.

The storage modulus G1 and the loss modulus G2 at 80° C. in the heating of the toner and the storage modulus G3 at 80° C. in the cooling of the toner preferably satisfy the following (Expression 3) and (Expression 4), more preferably the following (Expression 3a) and (Expression 4a).

$$1.00 \leq G2/G1 \leq 1.30 \quad \text{(Expression 3)}$$

$$0.80 \leq G3/G1 \quad \text{(Expression 4)}$$

$$1.00 \leq G2/G1 \leq 1.20 \quad \text{(Expression 3a)}$$

$$0.84 \leq G3/G1 \quad \text{(Expression 4a)}$$

The G2/G1 is a ratio of the loss modulus to the storage modulus at 80° C. in the heating the toner. When the G2/G1 is less than 1.00, the viscosity is so low that the toner hardly does plastic deformation, potentially degrading its low-temperature fixing property. When it is greater than 1.30, the viscosity is so high that its storageability may be degraded.

The G3/G1 indicates the recovery of elasticity when molten toner is cooled and cured. When the G3/G1 is less than 0.80, the elasticity is insufficient in a temperature region where sticking between paper sheets can occur, so that sticking between paper sheets may be easier to occur.

The storage modulus G5 at 120° C. in the heating of the toner is not particularly limited and may be appropriately selected depending on the intended purpose, but is preferably 3,000 Pa·s to 6,000 Pa·s. When the storage modulus G5 is more than 6,000 Pa·s, the toner is hard to spread on paper when fixed at low temperatures, and may be degraded in fixing property. Whereas when the storage modulus G5 is less than 3,000 Pa·s, molten toner is hard to be released and may be degraded in hot offset resistance although its fixing property is excellent.

Here, the storage modulus G1 at 80° C. in the heating of the toner, the loss modulus G2 at 80° C. in the heating of the toner, the storage modulus G5 at 120° C. in the heating of the toner, the storage modulus G3 at 80° C. in the cooling of the toner, and the loss modulus G4 at 80° C. in the cooling of the toner can be measured in the following manner, for example.

—Measurement of Storage Modulus and Loss Modulus—

One gram of a toner is molded with a press mold at room temperature (about 23° C.) and a pressure of 150 kg/cm$^2$ for 5 min, to thereby prepare a measurement sample having a diameter of 20 mm and a thickness of 2 mm.

Using a rotary flat-type rheometer (product of Rheometrics, Co.), a strain of 20% or less is applied to the thus-prepared measurement sample at a frequency of 1 Hz using parallel plates each having a diameter of 20 mm. In this state, the sample is heated at a heating rate of 1° C./min from 70° C. to 150° C., to thereby measure the storage modulus and the loss modulus of the sample; i.e., the storage modulus G1 at 80° C. in the heating, the loss modulus G2 at 80° C. in the heating, and the storage modulus G5 at 120° C. in the heating. After heated to 150° C., the sample is cooled from 150° C. to 70° C. at a cooling rate of 1° C./min, to thereby measure the storage modulus and the loss modulus of the sample; i.e., the storage modulus G3 at 80° C. in the cooling and the loss modulus G4 at 80° C. in the cooling.

The viscoelasticity (G1 to G5) of the toner can be controlled by adjusting the type and/or amount of the binder resin (non-crystalline resin and crystalline resin) used in the toner. For example, when toner materials contain a binder resin precursor (prepolymer) containing a site reactive with an active hydrogen group-containing compound; i.e., a modified polyester resin is contained as the non-crystalline resin in the toner, the binder resin precursor and the active hydrogen group-containing compound (e.g., amines) are allowed to undergo elongation and crosslinking reaction to form a gel polymer. This gel polymer has high elasticity, and thus it is possible to control the storage modulus and the loss modulus of the toner by adjusting, for example, the composition and/or amount of the binder resin precursor in the toner materials (the type and/or amount of the modified polyester resin in the toner). Also, since the crystalline resin (e.g., a crystalline polyester resin) in the toner drastically decreases in viscosity at a certain temperature to decrease the storage modulus of the toner, it is possible to control the storage modulus and the loss modulus of the toner by adjusting the composition and/or amount of the crystalline resin in the toner.

<Binder Resin>

The binder resin contains a non-crystalline resin and a crystalline resin.

<<Non-Crystalline Resin>>

The non-crystalline resin is preferably a non-crystalline polyester resin since the obtained toner is improved in low-temperature fixing property and glossiness when used in full-color image forming apparatuses.

The non-crystalline polyester resin preferably contains an unmodified polyester resin (i.e., a polyester resin that has not been modified) and a modified polyester resin.

—Unmodified Polyester Resin—

The unmodified polyester resin is not particularly limited and may be appropriately selected depending on the intended purpose. The unmodified polyester resin preferably contains an alcohol component in an amount of 45 mol % to 55 mol % with respect to all of the components and an acid component in an amount of 45 mol % to 55 mol % with respect to all of the components.

Examples of the alcohol component include ethylene glycol, propylene glycol, 1,3-butanediol, 1,4-butanediol, 2,3-butanediol, diethylene glycol and 1,6-hexanediol.

The acid component preferably contains a divalent carboxylic acid in an amount of 50 mol % or more with respect to all of the acid components. Examples of the divalent carboxylic acid include benzenedicarboxylic acids or anhydrides thereof such as phthalic acid, terephthalic acid, isophthalic acid and phthalic anhydride.

Among them, the alcohol component is preferably a bisphenol derivative, and the acid component is preferably dicarboxylic acids such as phthalic acid, terephthalic acid, isophthalic acid, anhydrides thereof, succinic acid, N-dodeceny succinic acid, anhydrides thereof, fumaric acid, meleic acid and maleic anhydride.

The weight average molecular weight (Mw) of the unmodified polyester resin which is measured by subjecting its tetrahydrofuran (THF) soluble matter to gel permeation chromatography (GPC) is not particularly limited and may be appropriately selected depending on the intended purpose, but is preferably 1,000 to 20,000, more preferably 2,000 to 10,000.

The number average molecular weight (Mn) of the unmodified polyester resin which is measured by subjecting its tetrahydrofuran (THF) soluble matter to gel permeation chromatography (GPC) is not particularly limited and may be appropriately selected depending on the intended purpose, but is preferably 500 to 6,000, more preferably 1,000 to 5,000.

The ratio (Mw/Mn) of the weight average molecular weight Mw to the number average molecular weight Mn of the unmodified polyester resin is not particularly limited and may be appropriately selected depending on the intended purpose, but is preferably 4 or less, more preferably 2 to 4. When the ratio Mw/Mn is more than 4, elasticity is high upon fixation, potentially impairing low-temperature fixing property. Whereas when it is less than 2, the obtained toner is impaired in heat resistance storage stability. In addition, the recovery of elasticity is small when heat is released from paper sheets, potentially making anti-sticking between discharged paper sheets insufficient.

The glass transition temperature of the unmodified polyester resin is not particularly limited and may be appropriately selected depending on the intended purpose, but is preferably 30° C. to 60° C., more preferably 35° C. to 55° C.

The glass transition temperature of the unmodified polyester resin can be determined from, for example, a DSC curve obtained through differential scanning calorimetry (DSC).

The acid value of the unmodified polyester resin is not particularly limited and may be appropriately selected depending on the intended purpose, but is preferably 1 mgKOH/g to 50 mgKOH/g, more preferably 10 mgKOH/g to 30 mgKOH/g.

The acid value can be measured according to the measurement method described in JIS K0070-1992.

—Modified Polyester Resin—

The modified polyester resin to be incorporated into the toner may be a modified polyester reactive with an active hydrogen group-containing compound (hereinafter referred to as "prepolymer"). The prepolymer is allowed to undergo elongation reaction with an active hydrogen group-containing compound (e.g., amines) in the toner to form a highly elastic polymer, which improves storageability, hot offset resistance and force of elasticity recovery of molten toner. The prepolymer is preferably a binder resin precursor formed of a modified polyester resin that has been modified with an isocyanate and/or an epoxy. For example, it is obtained by reacting an active hydrogen group-containing polyester with a polyisocyanate (PIC). Examples of the active hydrogen group contained in the polyester include a hydroxyl group (an alcoholic hydroxyl group and a phenolic hydroxyl group), an amino group, a carboxyl group and a mercapto group, with an alcoholic hydroxyl group being preferred.

The prepolymer is not particularly limited and may be appropriately selected depending on the intended purpose so long as it is a polyester resin containing at least a functional group reactive with the active hydrogen group-containing compound.

The functional group in the prepolymer reactive with the active hydrogen group is not particularly limited and may be appropriately selected from known substituents such as an isocyanate group, an epoxy group, a carboxylic acid group and an acid chloride group. One type of the functional group may be contained in the prepolymer, or two or more types of the functional group may be contained in the prepolymer. Among these substituents, an isocyanate group is preferred.

The method for synthesizing the prepolymer is not particularly limited and may be appropriately selected depending on the intended purpose. For producing an isocyanate group-containing prepolymer, the following method can be employed, for example. Specifically, a polyol and a polycarboxylic acid are heated to a temperature of 150° C. to 280° C. in the presence of a known esterification catalyst (e.g., tetrabutoxy titanate or dibutyltin oxide). Subsequently, the formed water is removed under reduced pressure if necessary, to prepare a polyester having a hydroxyl group. Thereafter, the thus-prepared polyester is reacted with a polyisocyanate at a temperature of 40° C. to 140° C. to prepare the isocyanate group-containing prepolymer.

The polyol is not particularly limited and may be appropriately selected depending on the intended purpose. Examples thereof include alkylene glycols (e.g., ethylene glycol, 1,2-propylene glycol and 1,6-hexanediol), bisphenols (e.g., bisphenol A, bisphenol F and bisphenol S) and adducts of bisphenols with alkylene oxides (e.g., bisphenol A ethylene oxide 2 mole adduct, bisphenol A propylene oxide 2 mole adduct and bisphenol A propylene oxide 3 mole adduct). These may be used alone or in combination.

Among them, polyols having a carbon ring are preferred since they reduce aggregation force acting between molecules due to steric hindrance by their ring to thereby prevent excessive increase in elasticity, with bisphenol derivatives being particularly preferred.

The polycarboxylic acid is not particularly limited and may be appropriately selected depending on the intended purpose. Examples thereof include alkylenedicarboxylic acids (e.g., succinic acid, adipic acid and sebacic acid); aromatic dicarboxylic acids (e.g., terephthalic acid and isophthalic acid); and tri- or higher-valent polycarboxylic acids (e.g., C9-C20 aromatic polycarboxylic acids such as trimellitic acid and pyromellitic acid). These may be used alone or in combination.

Among them, the polycarboxylic acids are preferably C8-C20 aromatic dicarboxylic acids for the same reasons as described for the polyols.

Instead of the polycarboxylic acids, anhydrides of the polycarboxylic acids and lower alkyl esters (e.g., methyl esters, ethyl esters and isopropyl esters) may be used.

The mixing ratio between the polyol and the polycarboxylic acid is not particularly limited and may be appropriately selected depending on the intended purpose. The mixing ratio therebetween is preferably 2/1 to 1/1, more preferably 1.5/1 to 1/1, particularly preferably 1.3/1 to 1.02/1, in terms of the equivalent ratio [OH]/[COOH] of the hydroxyl group [OH] of the polyol to the carboxyl group [COOH] the polycarboxylic acid.

The polyisocyanate is not particularly limited and may be appropriately selected depending on the intended purpose. Examples thereof include aliphatic polyisocyanates (e.g., tetramethylene diisocyanate, hexamethylene diisocyanate, trimethylhexane diisocyanate and tetramethylhexane diisocyanate). These may be used alone or in combination.

When reacting the polyisocyanate with the hydroxyl group-containing polyester, a solvent may be used if necessary. The solvent usable is not particularly limited and may be appropriately selected depending on the intended purpose. Examples thereof include solvents inert to an isocyanate such as aromatic solvents (e.g., toluene and xylene); ketones (e.g., acetone, methyl ethyl ketone and methyl isobutyl ketone); and esters (e.g., ethyl acetate). These may be used alone or in combination.

The mixing ratio between the polyisocyanate and the hydroxyl group-containing polyester is not particularly limited and may be appropriately selected depending on the intended purpose. The mixing ratio therebetween is preferably 5/1 to 1/1, more preferably 4/1 to 1.2/1, particularly preferably 2.5/1 to 1.5/1, in terms of the equivalent ratio [NCO]/[OH] of the isocyanate group [NCO] of the polyisocyanate to the hydroxyl group [OH] of the polyester. When the equivalent ratio [NCO]/[OH] is more than 5, the remaining polyisocyanate compound may adversely affect the chargeability of the formed toner.

The weight average molecular weight of the prepolymer, which is measured through GPC using its THF soluble matter, is not particularly limited and may be appropriately selected depending on the intended purpose, but is preferably $1.0\times10^4$ to $5.0\times10^4$. When it is smaller than the lower limit of this range, the molecular weight of the polyester after elongation reaction is small, and storageability and hot offset resistance may be insufficient. When it is larger than the upper limit of this range, the molecular weight of the polyester after elongation reaction is so large that fixing property may be degraded.

Also, the number of isocyanate groups contained in one molecular of the modified polyester is generally one or more on average, preferably 1.8 to 2.3 on average. When it is less than 1.8, the molecular weight of the polyester after elongation reaction is so small that sufficient elasticity cannot be obtained and that storageability and anti-sticking between discharged paper sheets may be degraded. When it is greater than 2.3, the molecular weight of the polyester after elongation reaction is large and the elasticity may be excessively high.

———Active Hydrogen Group-Containing Compound———

The active hydrogen group-containing compound acts, in an aqueous medium, as an elongating agent or crosslinking agent at the time of the elongating reaction or crosslinking reaction of the prepolymer.

The active hydrogen group is not particularly limited and may be appropriately selected depending on the intended purpose. Examples thereof include a hydroxyl group (e.g., an alcoholic hydroxyl group or a phenolic hydroxyl group), an amino group, a carboxyl group and a mercapto group. These may be contained alone or in combination.

The active hydrogen group-containing compound is not particularly limited and may be appropriately selected depending on the intended purpose. Examples thereof include water. In cases where the prepolymer is an isocyanate group-containing polyester prepolymer, amines are preferably used from the viewpoint of increasing the molecular weight of the reaction product.

The amines serving as the active hydrogen group-containing compound are not particularly limited and may be appropriately selected depending on the intended purpose. Examples thereof include diamines, tri- or higher-valent polyamines. Examples of the diamines include aromatic diamines (e.g., phenylenediamine, diethyltoluenediamine and 4,4'-diaminodiphenylmethane). Examples of the tri- or higher-valent polyamines include diethylenetriamine and triethylenetetramine. These may be used alone or in combination.

Among them, the amines are particularly preferably diamines and mixtures of diamines and a small amount of tri- or higher-valent polyamines.

The active hydrogen group-containing compound and the prepolymer are allowed to undergo the elongating and/or crosslinking reaction in an aqueous medium, to thereby obtain the modified polyester resin.

The elongating and/or crosslinking reaction may be terminated using a reaction terminator such as a monoamine (e.g., diethylamine, dibutylamine, butylamine or laurylamine) or a compound obtained by blocking the monoamine (e.g., a ketimine compound).

In the synthesis of the modified polyester resin, the mixing ratio between the isocyanate group-containing prepolymer serving as the prepolymer and the amine serving as the active hydrogen group-containing compound is not particularly limited and may be appropriately selected depending on the intended purpose. The equivalent ratio [NCO]/[NHx] of the isocyanate group [NCO] of the isocyanate group-containing prepolymer to the amino group [NHx] of the amine is not particularly limited and may be appropriately selected depending on the intended purpose, but is preferably 1/2 to 2/1, more preferably 1/1.5 to 1.5/1, particularly preferably 1/1.2 to 1.2/1.

The amount of the modified polyester resin in the toner is not particularly limited and may be appropriately selected depending on the intended purpose, but is preferably 1% by mass to 20% by mass, more preferably 5% by mass to 18% by mass. When it is less than 1% by mass, the obtained toner decreases in elasticity, so that its storage modulus G1 may be too low. Whereas when it is more than 20% by mass, the obtained toner excessively increases in elasticity, so that its storage modulus G1 may be too high.

<<Crystalline Resin>>

The toner of the present invention contains the crystalline resin and thus can be improved in low-temperature fixing property and also in anti-sticking between discharged paper sheets.

The crystalline structure of the crystalline resin tends to degrade near its melting point, so that the crystalline resin drastically decreases in viscosity. With this property, it can provide the toner with good low-temperature fixing property while keeping heat resistance storage stability high. Also, the crystalline resin rapidly recovers in elasticity when heat is released from paper sheets, improving anti-sticking between discharged paper sheets.

The crystalline resin is preferably a crystalline polyester resin from the viewpoint of improvements in low-temperature fixing property low-temperature fixing property and anti-sticking between discharged paper sheets.

The crystallinity and the molecular structure of the crystalline polyester resin may be confirmed, for example, by NMR, differential scanning calorimetry (DSC), X-ray diffraction, GC/MS, LC/MS, and measurement of infrared (IR) absorption spectrum. For example, in its infrared absorption spectrum, a polyester resin that exhibits absorption at wavelengths of 965 $cm^{-1}$-±10 $cm^{-1}$ and 990 $cm^{-1}$±10 $cm^{-1}$, which is based on an out-of-plane bending vibration (δCH) of the olefin, is preferred. In this case, it is possible to regard such a polyester resin that exhibits the above absorption as being crystalline.

The crystalline polyester resin can be synthesized through, for example, polycondensation reaction between an alcohol component and an acid component.

The alcohol component is not particularly limited and may be appropriately selected depending on the intended purpose. Suitable examples thereof include diol compounds.

The number of carbon atoms of the diol compounds is preferably 2 to 8, more preferably 2 to 6. Examples of such diol compounds include 1,4-butanediol, ethylene glycol, 1,2-propylene glycol, 1,3-propylene glycol and derivatives thereof. These may be used alone or in combination. Among them, 1,4-butanediol and 1,6-hexanediol are particularly preferred.

The amount of the diol compound(s) is not particularly limited and may be appropriately selected depending on the intended purpose, but is preferably 80 mol % or more in the alcohol component, more preferably 85 mol % to 100 mol % in the alcohol component.

When the amount of the diol compound(s) in the alcohol component is less than 80 mol %, production efficiency may be degraded.

The acid component is not particularly limited and may be appropriately selected depending on the intended purpose. Examples thereof include carboxylic acids having carbon-carbon double bonds, dicarboxylic acid compounds and polyvalent carboxylic acid compounds, with dicarboxylic acid compounds being preferred.

The number of carbon atoms of the dicarboxylic acid compounds is preferably 2 to 8, more preferably 2 to 6. Examples of such diol dicarboxylic acid compounds include oxalic acid, malonic acid, maleic acid, fumaric acid, citraconic acid, itaconic acid, glutaconic acid, succinic acid, adipic acid, anhydrides thereof, and C1-C3 alkyl esters of these acids. These may be used alone or in combination. Among them, fumaric acid is particularly preferred.

The amount of the dicarboxylic acid compound(s) is not particularly limited and may be appropriately selected depending on the intended purpose, but is preferably 80 mol % or more in the acid component, more preferably 85 mol % to 100 mol % in the acid component.

When the amount of the dicarboxylic acid compound(s) in the acid component is less than 80 mol %, production efficiency may be degraded.

Examples of the polyvalent carboxylic acid compounds include trimellitic acid, pyromellitic acid, anhydrides thereof, and C1-C3 alkyl esters of these acids.

The polycondensation reaction is not particularly limited and may be appropriately selected depending on the intended purpose. The polycondensation reaction can be performed by allowing the alcohol and acid components to react at 120° C. to 230° C. in an inert gas atmosphere using, for example, an esterification catalyst and a polymerization inhibitor.

In the polycondensation reaction, all of the monomers may be charged at one time in order to improve the strength of the obtained crystalline polyester resin. Also, in order to reduce the amount of low-molecular-weight components, divalent monomers may be allowed to react and then tri- or higher-valent monomers may be added to the reaction mixture and allowed to react. Furthermore, in order to promote the reaction, the reaction system may be reduced in pressure in the later half period of the polycondensation reaction. In order to control the crystallinity and the softening point of the crystalline polyester resin, the polycondensation reaction may be performed using, as the alcohol component, a trihydric or higher polyhydric alcohol such as glycerin and, as the acid component, a tri- or higher-valent carboxylic acid such as trimellitic anhydride to thereby obtain a non-linear polyester.

The molecular weight distribution of the crystalline polyester resin is not particularly limited and may be appropriately selected depending on the intended purpose. The molecular weight distribution thereof is preferably sharp. And, the crystalline polyester resin having a lower molecular weight is more preferred since it is excellent in low-temperature fixing property. In the molecular weight distribution diagram obtained through gel permeation chromatography (GPC) of its ortho-dichlorobenzene soluble matter where the horizontal axis represents log(M) and the vertical axis represents % by mass, it is preferred that a peak be located in a range of 3.5 to 4.0, and that the half width of the peak be 1.5 or less.

The weight average molecular weight (Mw) of the crystalline polyester resin is not particularly limited and may be appropriately selected depending on the intended purpose. Since it is difficult that the crystalline polyester resin having higher molecular weights keeps its sharp melt property, the weight average molecular weight (Mw) is preferably 1,000 to 30,000, more preferably 1,200 to 20,000.

The number average molecular weight (Mn) of the crystalline polyester resin is not particularly limited and may be appropriately selected depending on the intended purpose, but is preferably 500 to 6,000, more preferably 700 to 5,500.

The molecular weight distribution (Mw/Mn), which is expressed by a ratio of the weight average molecular weight (Mw) to the number average molecular weight (Mn), is not particularly limited and may be appropriately selected depending on the intended purpose, but is preferably 2 to 8.

When the molecular weight distribution (Mw/Mn) is less than 2, production is difficult to perform, potentially leading to cost elevation. Whereas when it is more than 8, the sharp melt property of the crystalline polyester resin may be degraded.

The melting point of the crystalline polyester resin is not particularly limited and may be appropriately selected depending on the intended purpose, but is preferably 60° C. to 130° C., more preferably 70° C. to 110° C. When the melting point thereof is lower than 60° C., the viscoelasticity of the obtained toner is decreased at low temperatures, so that its heat resistance storage stability may be degraded. Whereas it is higher than 130° C., the effect of decreasing its viscoelasticity is insufficient, so that its low-temperature fixing property may also be insufficient.

The melting point of the crystalline polyester resin can be determined from, for example, a DSC curve obtained through differential scanning calorimetry (DSC).

The acid value of the crystalline polyester resin is not particularly limited and may be appropriately selected depending on the intended purpose, but is preferably 5 mgKOH/g or higher, more preferably 10 mgKOH/g or higher. Meanwhile, from the viewpoint of improving hot offset resistance, the acid value is preferably 45 mgKOH/g or lower.

When the acid value is lower than 5 mgKOH/g, satisfactory affinity between recording media (paper) and the binder resin cannot be obtained. In addition, the intended low-temperature fixing property cannot be achieved.

The acid value of the crystalline polyester resin can be measured as follows, for example. Specifically, the crystalline polyester resin is dissolved in 1,1,1,3,3,3-hexafluoro-2-propanol and the resultant solution is subjected to titration.

The hydroxyl value of the crystalline polyester resin is not particularly limited and may be appropriately selected depending on the intended purpose, but is preferably 0 mgKOH/g to 50 mgKOH/g, more preferably 5 mgKOH/g to 50 mgKOH/g.

When the hydroxyl value thereof is higher than 50 mgKOH/g, it may be impossible to attain both good low-temperature fixing property and good charging property.

The hydroxyl value of the crystalline polyester resin can be measured as follows, for example. Specifically, the crystalline polyester resin is dissolved in 1,1,1,3,3,3-hexafluoro-2-propanol and the resultant solution is subjected to titration.

The amount of the crystalline polyester resin (i.e., the crystalline resin) in the toner is not particularly limited and may be appropriately selected depending on the intended purpose, but is preferably 0.1% by mass to 10% by mass, more preferably 1.5% by mass to 7.8% by mass.

When the amount thereof is less than 0.1% by mass, the obtained toner excessively increases in elasticity, so that its storage modulus G1 may be too high. Whereas when it is more than 10% by mass, the obtained toner decreases in elasticity, so that its storage modulus G1 may be too low.

<Releasing Agent>

The releasing agent has to have a melting point of 55° C. to 80° C., preferably 58° C. to 72° C. When the melting point thereof is lower than 55° C., the releasing agent melts at low temperatures, potentially imparing heat resistance storage stability. Also, the releasing agent having exuded on the image after fixation takes much time to be cured, potentially leading to degradation of sticking between discharged paper sheets. When the melting point of the releasing agent is higher than 80° C., the releasing agent is hard to melt, potentially imparing heat resistance storage stability.

Here, the melting point of the releasing agent was determined from, for example, a DSC curve obtained through differential scanning calorimetry (DSC). The DSC curve can be obtained using TA-60WS and DSC-60 (product of Shimadzu Corporation).

The releasing agent is preferably an ester wax having the above melting point.

The ester wax is preferably a monoester synthesized from a linear fatty acid containing a long-chain alkyl group and from a monohydric alcohol, or a saturated ester synthesized from a linear fatty acid and a polyhydric alcohol. From the viewpoints of fixing property and releasing property, a monoester wax is particularly preferred.

The ester wax used may be an appropriately synthesized one or a commercially available one.

The ester wax is generally synthesized through esterification reaction between a long-chain fatty acid or polycarboxylic acid and a long-chain higher alcohol or polyhydric alcohol.

Each of the long-chain fatty acid or polycarboxylic acid and the long-chain higher alcohol or polyhydric alcohol is usually obtained from natural products. In general, they are mixtures containing compounds each having an even number of carbon atoms.

The long-chain fatty acid is not particularly limited and may be appropriately selected depending on the intended purpose. Examples thereof include myristic acid, palmitic acid, stearic acid and behenic acid. These may be used alone or in combination.

Examples of the polycarboxylic acid include: benzenedicarboxylic acids (e.g., phthalic acid, isophthalic acid and terephthalic acid) and anhydrides thereof; and alkyldicarboxylic acids (e.g., succinic acid, adipic acid and sebacic acid) and anhydrides thereof. These may be used alone or in combination.

The long-chain higher alcohol is not particularly limited and may be appropriately selected depending on the intended purpose. Examples thereof include lauryl alcohol, stearyl alcohol and behenyl alcohol. These may be used alone or in combination.

Examples of the polyhydric alcohol include ethylene glycol, propylene glycol, 1,3-butanediol and 1,4-butanediol. These may be used alone or in combination.

The esterification reaction is performed, for example, at a reaction temperature of lower than 250° C. under normal pressure or reduced pressure, preferably in an inert gas such as nitrogen. The ratio between the long-chain fatty acid or polycarboxylic acid and the long-chain higher alcohol or polyhydric alcohol is not particularly limited and may be appropriately selected depending on the intended purpose. The esterification reaction may be performed in the presence of a small amount of an esterification catalyst or a solvent.

Examples of the esterification catalyst include organic titanium compounds such as tetrabutoxytitanate and tetrapropioxytitanate; organic tin compounds such as butyltin dilaurate and dibutyltin oxide; and other organic lead compounds, sulfuric acid and p-toluenesulfonic acid. Examples of the solvent include aromatic solvents such as toluene, xylene and mineral spirits.

When the long-chain fatty acid or polycarboxylic acid is esterified directly with the long-chain higher alcohol or polyhydric alcohol, various by-products having similar structures to an ester compound of interest are produced and tend to adversely affect properties of the toner. Therefore, starting materials and/or reaction products are purified through extraction with a solvent and/or distillation under reduce pressure to obtain an ester wax.

Regarding a distribution of the numbers of carbon atoms, the ester wax preferably contains ester compounds having 44 or more carbon atoms in an amount of 45% to 55%. Such ester wax exhibits sharp thermal melting behavior that it quickly melts in the vicinity of its melting point. Thus, the ester wax imparts sufficient releasing property to the toner without impairing its heat resistance storage stability. When the percentage of the ester compounds having 44 or more carbon atoms is lower than 45%, the heat resistance storage stability of the obtained toner may be degraded. Whereas when it is higher than 55%, the distribution of the numbers of carbon atoms becomes so sharp that the strength of a solid of ester wax becomes low; i.e., the solid of ester wax becomes too soft. Such ester wax present on the toner surface may cause spent of the toner to a charging unit.

Here, the distribution of the numbers of carbon atoms of the ester wax can be measured using, for example, a gas chromatography apparatus equipped with a capillary column (TGA apparatus model Q5000IR, product of TA Instruments of high-sensitive TGA). Specifically, the percentage of the ester compounds having 44 or more carbon atoms in the ester wax is obtained by calculating the percentage of a peak area of linear monoester compounds having 44 or more carbon atoms relative to the sum of peak areas of the ester wax on the gas chromatogram chart.

The kinetic viscosity at 100° C. of the ester wax is preferably 10 mPa·s or lower since such ester wax exudes quickly to improve the toner in low-temperature fixing property and offset resistance.

Also, the half width of the endothermic main peak of the ester wax measured by DSC is less than 10° C. since such ester wax quickly melts during fixation to improve the toner in low-temperature fixing property and offset resistance.

The amount of the releasing agent in the toner is not particularly limited and may be appropriately selected depending on the intended purpose, but is preferably 3% by mass to 40% by mass, more preferably 5% by mass to 35% by mass.

When the amount thereof is less than 3% by mass, hot offset resistance decreases and when a double-sided image is fixed, the image on the rear surface tends to involve an offset phenomenon. When it is more than 40% by mass, toner particles tend to aggregate during granulation using the polymerization method. The resultant toner particles tend to have a broad particle size distribution and may easily decrease in durability to heat.

<Colorant>

The colorant is not particularly limited and may be appropriately selected depending on the intended purpose. Examples thereof include carbon black, nigrosine dye, iron black, naphthol yellow S, pigment yellow L, isoindolinon yellow, colcothar, cadmium red and cadmium mercury red.

The amount of the colorant in the toner is not particularly limited and may be appropriately selected depending on the intended purpose, but is preferably 1% by mass to 15% by mass, more preferably 3% by mass to 10% by mass. When it is less than 1% by mass, coloring capability may be insufficient. When it is more than 15% by mass, the colorant may impair fixation of the toner.

The colorant may be mixed with a resin to form a masterbatch and may be used as a masterbatch. Examples of the resin which is used for producing a masterbatch or which is kneaded together with a masterbatch include the above-described modified or unmodified polyester resins; styrene polymers and substituted products thereof such as polystyrenes, poly-p-chlorostyrenes and polyvinyltoluenes. These may be used alone or in combination.

The masterbatch can be prepared by mixing/kneading a colorant with a resin for use in a masterbatch through application of high shearing force. Also, an organic solvent may be used for improving mixing between the colorant and the resin. Furthermore, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required). In this mixing/kneading, a high-shearing disperser (e.g., a three-roll mill) is preferably used.

<Other Ingredients>

The other ingredients are not particularly limited and may be appropriately selected depending on the intended purpose. Examples thereof include charge-controlling agents, resin particles, external additives, flowability improving agents, cleanability improving agents and magnetic materials.

—Charge-Controlling Agent—

The charge-controlling agent is not particularly limited and may be appropriately selected from known charge-controlling agents depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. These may be used alone or in combination.

The charge-controlling agent may be a commercially available product. Examples of the commercially available product include nigrosine dye BONTRON 03, quaternary ammonium salt BONTRON P-51, and polymeric compounds having, as a functional group, a sulfonic acid group, a carboxyl group or a quaternary ammonium salt.

The amount of the charge-controlling agent in the toner is not particularly limited, and depends on the type of the binder resin, the presence or absence of additive(s) and the dispersing method employed and therefore cannot be unequivocally determined. The amount thereof is preferably 0.1 parts by mass to 10 parts by mass, more preferably 0.2 parts by mass to 5 parts by mass, per 100 parts by mass of the resin component. When it is less than 0.1 parts by mass, favorable charge controlling properties may not be obtained. Whereas when it is greater than 10 parts by mass, the chargeability of the toner is so large that the effects of a main charge-controlling agent are reduced, and the electrostatic attraction force between the toner and a developing roller increases, which possibly leads to degradation of the fluidity of a developer and/or image density.

The charge-controlling agent may be dissolved or dispersed in the toner after melt-kneaded with the masterbatch and the resin. Needless to say, the charge-controlling agent may be directly added to the organic solvent together with the components of the toner when they are dissolved or dispersed, or may be fixed on the surface of toner particles after the formation of the toner particles.

—Resin Particles—

The resin particles are not particularly limited and may be appropriately selected depending on the intended purpose. Examples thereof include vinyl resins, polyurethane resins, epoxy resins and polyester resins. Among them, vinyl resins, polyurethane resins, epoxy resins, polyester resins and combinational use thereof are preferred since it is easy to obtain an aqueous dispersion of fine spherical resin particles, with vinyl resins being more preferred.

The vinyl resins are homopolymers or copolymers of vinyl monomers. Examples of the vinyl resins include styrene-(meth)acrylic acid ester resins, styrene-butadiene copolymers, (meth)acrylic acid-acrylic acid ester polymers, styrene-acrylonitrile copolymers, styrene-maleic anhydride copolymers and styrene-(meth)acrylic acid copolymers, with styrene-butyl methacrylate copolymers being preferred.

The resin particles may be copolymers formed of monomers each containing at least two unsaturated groups.

The monomer containing at least two unsaturated groups is not particularly limited and may be appropriately selected depending on the intended purpose. Examples thereof include a sodium salt of sulfuric acid ester of methacrylic acid-ethylene oxide adduct ("ELEMINOL RS-30," product of Sanyo Chemical Industries, Ltd.), divinyl benzene and 1,6-hexanediol acrylate.

The resin particles are not particularly limited and may be appropriately selected depending on the intended purpose. The glass transition temperature (Tg) of the resin particles is preferably 50° C. to 70° C. When the glass transition temperature (TO is lower than 50° C., the obtained toner is degraded in heat resistance storage stability, so that blocking may occur during storage and in a developing unit. Whereas when it is higher than 70° C., the resin particles impair adhesiveness to paper, so that the minimum fixing temperature may be increased.

The weight average molecular weight of the resin particles is not particularly limited and may be appropriately selected depending on the intended purpose, but is preferably 9,000 to 200,000. When the weight average molecular weight thereof is lower than 9,000, the obtained toner may be degraded in heat resistance storage stability. Whereas when it is higher than 200,000, the obtained toner may be degraded in low-temperature fixing property.

The average particle diameter of the resin particles is not particularly limited and may be appropriately selected depending on the intended purpose, but is preferably 5 nm to 200 nm, more preferably 20 nm to 150 nm.

The amount of the resin particles in the toner is not particularly limited and may be appropriately selected depending on the intended purpose, but is preferably 0.5% by mass to 5.0% by mass. When the amount thereof is less than 0.5% by mass, it may be difficult to control the surface hardness and the fixing property of the toner. Whereas when it is more than 5.0% by mass, the resin particles prevent the wax from exuding, potentially causing offset.

—External Additive—

The external additive is not particularly limited and may be appropriately selected depending on the intended purpose. Examples thereof include silica particles, hydrophobized silica particles, titanium oxide particles, hydrophobized titanium oxide particles, alumina particles, hydrophobized alumina particles, fatty acid metal salts (e.g., zinc stearate and aluminum starate), metal oxides (e.g., tin oxide and antimony oxide) and fluoropolymers, with silica particles, titanium oxide particles and hydrophobized titanium oxide particles being preferred.

Examples of the silica particles include R972, R974 and RX200 (these products are of AEROSIL Japan).

Examples of the titanium oxide particles include P-25 (product of AEROSIL Japan), STT-30, STT-65C-S (these products are of Titan Kogyo, Ltd.), TAF-140 (product of Fuji Titanium Industry Co., Ltd.), MT-150W, MT-500B, MT-600B and MT-150A (these products are of TAYCA Corporation).

Examples of the hydrophobized titanium oxide particles include T-805 (product of AEROSIL Japan), STT-30A, STT-65S-S (these products are of Titan Kogyo, Ltd.), TAF-500T, TAF-1500T (these products are of Fuji Titanium Industry Co., Ltd.), MT-100S, MT-100T (these products are of TAYCA Corporation) and ITS (product of ISHIHARA SANGYO KAISHA, LTD.).

The hydrophobized silica particles, hydrophobized titanium oxide particles or hydrophobized alumina particles can be obtained by treating hydrophilic particles with a silane coupling agent such as methyltrimethoxysilane, methyltriethoxysilane or octyltrimethoxysilane. In addition, suitably used are silicone oil-treated oxide particles or silicone oil-treated inorganic particles.

Examples of the silicone oil include dimethyl silicone oil, methylphenyl silicone oil, methylhydrogen silicone oil, alkyl-modified silicone oil and fluorine-modified silicone oil. Examples of the inorganic particles include silica, alumina, titanium oxide, barium titanate, magnesium titanate, calcium titanate and strontium titanate, with silica and titanium oxide being particularly preferred.

The amount of the external additive in the toner is not particularly limited and may be appropriately selected depending on the intended purpose, but is preferably 0.1% by mass to 5% by mass, more preferably 0.3% by mass to 3% by mass.

The average particle diameter of primary particles of the inorganic particles is not particularly limited and may be appropriately selected depending on the intended purpose, but is preferably 100 nm or less, more preferably 3 nm to 70 nm. When the average particle diameter of primary particles of the inorganic particles is less than 3 nm, the inorganic particles are embedded in the toner, making it difficult for them to effectively exhibit their functions. Whereas when it is more than 100 nm, the inorganic particles may unevenly scratch the surface of the photoconductor.

—Flow Ability Improving Agent—

The flowability improving agent refers to an agent capable of improving hydrophobic properties through surface treatment and preventing degradation of flowability and/or chargeability even under high humidity environment. Examples thereof include silane coupling agents, silylation agents, silane coupling agents having a fluorinated alkyl group, organotitanate coupling agents, aluminum coupling agents, silicone oils, and modified silicone oils.

—Cleanability Improving Agent—

The cleanability improving agent is added to the toner for removing the developer remaining after transfer on the photoconductor and primary transfer medium. Examples of the cleanability improving agent include metal salts of fatty acids such as stearic acid (e.g., zinc stearate and calcium stearate), polymer particles formed by soap-free emulsion polymerization, such as polymethyl methacrylate particles and polystylene particles. The polymer particles preferably have a relatively narrow particle size distribution. It is preferable that the volume average particle diameter thereof be 0.01 μm to 1 μm.

—Magnetic Material—

The magnetic material is not particularly limited and may be appropriately selected depending on the intended purpose. Examples thereof include iron powder, magnetite and ferrite. It is preferably white in terms of color tone.

<Method for Producing the Toner>

In a method for producing the toner of the present invention, the toner of the present invention is produced by: dispersing, in an aqueous medium, a solution or dispersion liquid which is obtained by dissolving or dispersing, in an organic solvent, an active hydrogen group-containing compound, a binder resin precursor containing a site reactive with the active hydrogen group-containing compound, a binder resin containing a non-crystalline resin and a crystalline resin, a colorant and a releasing agent, to thereby prepare an emulsified dispersion liquid; allowing the binder resin precursor and the active hydrogen group-containing compound to react in the emulsified dispersion liquid; and removing the organic solvent. Specifically, this method includes an oil phase preparation step, an aqueous phase preparation step, a toner dispersion liquid preparation step and a solvent removal step; and, if necessary, further includes other steps.

<<Oil Phase Preparation Step>>

The oil phase preparation step is not particularly limited and may be appropriately selected depending on the intended purpose so long as it is a step of dissolving or dispersing, in an organic solvent, an active hydrogen group-containing compound, a binder resin precursor containing a site reactive with the active hydrogen group-containing compound, a binder resin containing a non-crystalline resin and a crystalline resin, a colorant and a releasing agent, to thereby prepare a solution or dispersion liquid.

The oil phase preparation step is performed by, for example, a method in which the active hydrogen group-containing compound, the binder resin precursor containing the site reactive with the active hydrogen group-containing compound, the binder resin containing the non-crystalline resin and the crystalline resin, the binder resin, the colorant, the releasing agent, and an optionally used charge-controlling agent are gradually added to the organic solvent under stirring to dissolve or disperse them in the organic solvent.

When a pigment is used as the colorant or when ingredients poorly dissolvable in the organic solvent such as the charge-controlling agent are added to the organic solvent, these ingredients are preferably micronized prior to the addition of them to the organic solvent.

The below-described formation of the colorant into a masterbatch is one suitable method, and the same method can be applied to the ester wax and the charge-controlling agent.

In another employable method, the colorant, the releasing agent, the charge-controlling agent, and other ingredients are dispersed through a wet process in the presence of an optionally added dispersing aid to prepare a wet master.

Alternatively, when dispersing ingredients that melt at a temperature lower than the melting point of the organic solvent, these ingredients are heated and dissolved once while being stirred in the organic solvent together with the dispersoids in the presence of an optionally added dispersing aid, followed by cooling with stirring or shearing for precipitation, to thereby form microcrystals of the dispersoids.

After the colorant, the releasing agent and, if necessary, the charge-controlling agent which have been dispersed by the above method are dissolved or dispersed in the organic solvent together with the active hydrogen group-containing compound, the binder resin precursor containing the site reactive with the active hydrogen group-containing compound and the binder resin, the resultant solution or dispersion liquid may further be dispersed. This dispersion can be performed using a known disperser such as a beads mill or a disc mill.

Also, in order to increase the mechanical strength of the obtained toner and prevent high-temperature offset during fixing, the toner is preferably produced in a state where the binder resin precursor containing the site reactive with the active hydrogen group-containing compound has been dissolved in the oil phase; i.e., in a state where the oil phase contains the active hydrogen group-containing compound and the binder resin precursor.

The organic solvent used in the oil phase preparation step is not particularly limited and may be appropriately selected depending on the intended purpose. The organic solvent preferably has a boiling point of lower than 100° C. since such an organic solvent can easily be removed. Examples of such organic solvent include toluene, xylene, benzene, carbon tetrachloride, methylene chloride, 1,2-dichloroethane, methyl acetate, ethyl acetate, methyl ethyl ketone and methyl isobutyl ketone. These may be used alone or in combination.

When the binder resin to be dissolved or dispersed in the organic solvent is a resin having a polyester skeleton, use of ester solvents such as methyl acetate, ethyl acetate and butyl acetate, and ketone solvents such as methyl ethyl ketone and methyl isobutyl ketone is preferred since they are excellent in dissolution capability. Among them, particularly preferred are methyl acetate, ethyl acetate and methyl ethyl ketone since they can easily be removed.

<<Aqueous Phase Preparation Step>>

The aqueous phase preparation step is not particularly limited and may be appropriately selected depending on the intended purpose so long as it is a step of preparing an aqueous phase.

The aqueous medium used in the aqueous phase preparation step is not particularly limited and may be appropriately selected depending on the intended purpose, and examples thereof include water. The aqueous medium may be water alone or a mixture of water and a water-miscible organic solvent. Examples of the water-miscible organic solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

The aqueous medium preferably further contains a surfactant.

The surfactant is not particularly limited and may be appropriately selected depending on the intended purpose. Examples thereof include anionic surfactants such as alkylbenzenesulfonic acid salts, α-olefin sulfonic acid salts, phosphoric acid esters and disulfonic acid salts; cationic surfactants such as alkyl amine salts, aminoalcohol fatty acid derivatives, polyamine fatty acid derivatives and quaternary ammonium salts (e.g., benzethonium chloride); and amphoteric surfactants such as fatty acid amide derivatives. Among them, in order to efficiently disperse the oil droplets containing the solvent, a disulfonic acid salt having a relatively high HLB is preferred.

The amount of the surfactant in the aqueous medium is not particularly limited and may be appropriately selected depending on the intended purpose. The concentration of the surfactant in the aqueous medium is preferably 3% by mass to 10% by mass, more preferably 4% by mass to 9% by mass, particularly preferably 5% by mass to 8% by mass. When the concentration thereof is lower than 3% by mass, the oil droplets cannot be stably dispersed to form coarse oil droplets. When the concentration thereof is higher than 10% by mass, each oil droplet becomes too small and also forms an inverted micellar structure, so that the dispersion stability is conversely degraded due to the surfactant to lead to formation of coarse oil droplets.

<<Toner Dispersion Liquid Preparation Step>>

The toner dispersion liquid preparation step is not particularly limited and may be appropriately selected depending on the intended purpose so long as it is a step of dispersing the oil phase in the aqueous phase to prepare the emulsified dispersion liquid (toner dispersion liquid)

The dispersion method is not particularly limited and may be appropriately selected depending on the intended purpose. Examples thereof include a dispersion method using a known disperser such as a low-speed shearing disperser, a high-speed shearing disperser, a friction disperser, a high-pressure jet disperser or an ultrasonic disperser. Among them, dispersion using a high-speed shearing disperser is preferred in order to form the toner base particles having a particle diameter of 2 μm to 20 μm. The rotation speed of the high-speed shearing disperser is not particularly limited and may be appropriately selected depending on the intended purpose, but is preferably 1,000 rpm to 30,000 rpm, more preferably 5,000 rpm to 20,000 rpm. The dispersion time is not particularly limited and may be appropriately selected depending on the intended purpose. It is preferably 0.1 min to 5 min in a batch method. When the dispersion time exceeds 5 min, unfavorable small particles remain and excessive dispersion is performed to make the dispersion system unstable, potentially forming aggregates and coarse particles. The dispersion temperature is not particularly limited and may be appropriately selected depending on the intended purpose. It is generally 0° C. to 40° C., preferably 10° C. to 30° C. When the dispersion temperature is lower than 0° C., the dispersion is increased in viscosity to require increased shearing energy for dispersing, potentially leading to a drop in production efficiency. When it exceeds 40° C., molecular movements are excited to degrade dispersion stability, potentially forming aggregates and coarse particles easily.

The amount of the organic solvent in the toner dispersion liquid is not particularly limited and may be appropriately selected depending on the intended purpose, but is preferably 10% by mass to 70% by mass, more preferably 25% by mass to 60% by mass, particularly preferably 40% by mass to 55% by mass.

The amount of the organic solvent in the toner dispersion liquid is an amount relative to the amount of the solid matter (e.g., the binder resin, the colorant, the releasing agent and, if necessary, the charge-controlling agent) in the toner dispersion liquid.

<<Solvent Removal Step>>

The solvent removal step is not particularly limited and may be appropriately selected depending on the intended purpose so long as it is a step of removing the organic solvent from the toner dispersion liquid. The solvent removal step is preferably a step of completely removing the organic solvent contained in the toner dispersion liquid. In one employable means, the toner dispersion liquid is gradually increased in temperature with stirring, to thereby completely evaporate off the organic solvent contained in the liquid droplets. In another employable means, the toner dispersion liquid is sprayed toward a dry atmosphere with stirring, to thereby completely evaporate off the organic solvent contained in the liquid droplets. In still another employable means, the toner dispersion liquid is reduced in pressure with stirring to evaporate off the organic solvent. The latter two means may be used in combination with the first means.

The dry atmosphere toward which the toner dispersion liquid is not particularly limited and may be appropriately selected depending on the intended purpose. It uses heated gas such as air, nitrogen, carbon dioxide gas and combustion gas.

The temperature of the dry atmosphere is not particularly limited and may be appropriately selected depending on the intended purpose. It is preferably a temperature equal to or higher than the highest boiling point of the solvents used.

The spraying is performed with, for example, a spray dryer, a belt dryer or a rotary kiln. Using them in an even short time can give a product having satisfactory quality.

<<Other Steps>>

The other steps are not particularly limited and may be appropriately selected depending on the intended purpose. Examples thereof include an aging step, a washing step and a drying step.

—Aging Step—

When the oil phase contains the polyester resin (prepolymer) containing the functional group reactive with the active hydrogen group of the active hydrogen group-containing compound, an aging step is preferably performed for proceeding elongation and/or crosslinking reaction of the prepolymer.

The aging step is preferably performed after the solvent removal step and before the washing step.

The aging time in the aging step is not particularly limited and may be appropriately selected depending on the intended purpose, but is preferably 10 min to 40 hours, more preferably 2 hours to 24 hours.

The reaction temperature in the aging step is not particularly limited and may be appropriately selected depending on the intended purpose, but is preferably 0° C. to 65° C., more preferably 35° C. to 50° C.

—Washing Step—

The washing step is not particularly limited and may be appropriately selected depending on the intended purpose so long as it is a step of washing the toner particles (toner base particles) in the toner dispersion liquid subsequent to the solvent removal step or the aging step.

The toner dispersion liquid contains not only the toner base particles but also such subsidiary materials as the dispersing agent (e.g., surfactant). Thus, the toner dispersion liquid is washed to separate the toner base particles from the subsidiary materials.

The washing method of the toner base particles is not particularly limited and may be appropriately selected depending on the intended purpose. Examples thereof include a centrifugal separation method, a reduced-pressure filtration method and a filter press method. Any of the above methods forms a cake of the toner base particles. If the toner base particles are not sufficiently washed through only one washing process, the obtained cake may be dispersed again in an aqueous medium to form a slurry, which is repeatedly treated with any of the above methods to take out the toner base particles. When a reduced-pressure filtration method or a filter press method is employed for washing, an aqueous medium may be made to penetrate the cake to wash out the subsidiary materials contained in the toner base particles. The aqueous medium used for washing is water or a solvent mixture of water and an alcohol such as methanol or ethanol. Use of water is preferred from the viewpoint of reducing cost and environmental load caused by, for example, drainage treatment.

—Drying Step—

The drying step is not particularly limited and may be appropriately selected depending on the intended purpose so long as it is a step of drying the toner base particles after the washing step.

The washed toner base particles containing a large amount of water are dried to remove the water, whereby only toner base particles can be obtained.

The method for removing water from the toner base particles is not particularly limited and may be appropriately selected depending on the intended purpose. Examples thereof include methods using dryers such as a spray dryer, a vacuum freezing dryer, a reduced-pressure dryer, a ventilation shelf dryer, a movable shelf dryer, a fluidized-bed-type dryer, a rotary dryer and a stirring-type dryer.

The removal of water is preferably performed until the water content of the toner base particles is decreased less than 1% by mass. Also, when the toner base particles after the removal of water somewhat flocculate to cause inconvenience in use, the flocculated particles may be separated from each other through beating using, for example, a jet mill, HENSCHEL MIXER or a super mixer.

The color of the toner of the present invention is not particularly limited and may be appropriately selected depending on the intended purpose. The toner may be formed into at least one selected from black toner, cyan toner, magenta toner and yellow toner. Each color toner can be obtained by appropriately selecting the color of the colorant.

(Developer)

A developer of the present invention contains at least the above-described toner; and, if necessary, further contains appropriately selected other ingredients such as a carrier. This developer may be a one-component developer or a two-component developer. However, the two-component developer is preferred when used in, for example, high-speed printers responding to the recent improvements in data processing speed, since the service life of the two-component developer is prolonged.

The one-component developer containing the toner of the present invention changes in particle diameter of the toner particles to a lesser extent even after the toner particles are consumed and supplied repeatedly. The one-component developer does not cause filming of the toner on a developing roller or fusion of the toner on a member for thinning a toner layer (e.g., a blade). The one-component developer can exhibit good, stable develop ability and image formation even when used (stirred) for a long period of time. The two-component developer containing the toner of the present invention changes in particle diameter of the toner particles to a lesser extent even after the toner particles are consumed and supplied repeatedly. The two-component developer can exhibit good, stable developability and image formation even when stirred for a long period of time.

The carrier is not particularly limited and may be appropriately selected depending on the intended purpose, but is preferably a carrier containing a core material and a resin layer coating the core material.

The material of the core material is not particularly limited and may be appropriately selected from known materials. For example, it is preferable to employ manganese-strontium (Mn—Sr) materials of 50 emu/g to 90 emu/g or manganese-magnesium (Mn—Mg) materials of 50 emu/g to 90 emu/g. Furthermore, it is preferable to employ high magnetization materials such as iron powder of 100 emu/g or more or magnetite of 75 emu/g to 120 emu/g for the purpose of securing image density. Moreover, it is preferable to employ low magnetization materials such as copper-zinc (Cu—Zn) of 30 emu/g to 80 emu/g because the impact toward the photoconductor having the developer in the form of magnetic brush can be relieved and because it is advantageous for higher image quality. These may be used alone or in combination.

The volume average particle diameter of the core materials is not particularly limited and may be appropriately selected depending on the intended purpose. It is preferably 10 μm to 150 μm, more preferably 20 μm to 80 μm.

When the average particle diameter (volume average particle diameter (D50)) is less than 10 μm, the amount of fine powder increases in the carrier, whereas magnetization per particle decreases and carrier scattering may occur. When it is greater than 150 μm, the specific surface area of the carrier decreases and thus toner scattering may occur. As a result, in the case of printing a full-color image having many solid portions, especially the reproduction of the solid portions may decrease.

The material of the resin layer is not particularly limited and may be appropriately selected from known resins depending on the intended purpose. Examples thereof include amino resins, polyvinyl resins, polystyrene resins, polyester resins, polycarbonate resins and polyethylene resins. These may be used alone or in combination.

Examples of the amino resins include melamine resins and epoxy resins. Examples of the polyvinyl resins include acrylic resins and polyacrylonitrile resins. Examples of the polystyrene resins include polystyrene resins and styrene-acrylic copolymers. Examples of the polyester resins include polyethylene terephthalate resins and polybutylene terephthalate resins.

If necessary, the resin layer may further contain, for example, electroconductive powder. Examples of the electroconductive powder include metal powder, carbon black, titanium oxide, tin oxide and zinc oxide. The average particle diameter of the electroconductive powder is preferably 1 μm or less. When the average particle diameter is in excess of 1 μm, electrical resistance may be difficult to control.

The resin layer may be formed, for example, as follows. Specifically, a silicone resin and other materials are dissolved in a solvent to prepare a coating liquid, and then the thus-prepared coating liquid is coated on the surface of the core material with a known coating method, followed by drying and then baking. Examples of the coating method include immersion coating methods, spray methods and brush coating methods.

The solvent is not particularly limited and may be appropriately selected depending on the intended purpose. Examples thereof include toluene, xylene, methyl ethyl ketone, methyl isobutyl ketone and butyl cellosolve acetate.

The baking method is not particularly limited and may be an external or internal heating method. Examples of the apparatus for the baking include methods employing a fixed-type electric furnace, a fluid-type electric furnace, a rotary electric furnace or a burner furnace; and methods employing microwave radiation.

The amount of the resin layer in the carrier is not particularly limited and may be appropriately selected depending on the intended purpose, but is preferably 0.01% by mass to 5.0% by mass. When the amount thereof is less than 0.01% by mass, a uniform resin layer may not be formed on the surface of the core material. Whereas when it is more than 5.0% by mass, the formed resin layer becomes so thick that adhesion between carrier particles occurs, potentially resulting in failure to form uniform carrier particles.

When the developer is the two-component developer, the amount of the carrier in the two-component developer is not particularly limited and may be appropriately selected depending on the intended purpose, but is preferably 90% by mass to 98% by mass, more preferably 93% by mass to 97% by mass.

<Developer Accommodating Container>

A developer accommodating container used in the present invention accommodates the developer of the present invention. The container is not particularly limited and may be appropriately selected. Examples thereof include those having a cap and a container main body. This developer accommodating container has excellent handleability; i.e., is suitable for storage and/or transportation and is suitably used for supply of a developer with being detachably mounted to, for example, the below-described process cartridge and image forming apparatus.

(Image Forming Apparatus and Image Forming Method)

An image forming apparatus of the present invention includes at least a latent electrostatic image bearing member, a charging unit, a light-exposing unit, a developing unit, a transfer unit and a fixing unit; and, if necessary, further includes appropriately selected other units such as a charge-eliminating unit, a cleaning unit, a recycling unit and a controlling unit. Notably, the charging unit and the light-exposing unit may collectively be referred to as a latent electrostatic image forming unit.

An image forming method used in the present invention includes at least a charging step, a light-exposing step, a developing step, a transfer step and a fixing step; and, if necessary, appropriately selected other steps such as a charge-eliminating step, a cleaning step, a recycling step and a controlling step. Notably, the charging step and the light-exposing step may collectively be referred to as a latent electrostatic image forming step.

The image forming method used in the present invention can suitably be performed with the image forming apparatus of the present invention. The charging step can be performed with the charging unit. The light-exposing step can be performed with the light-exposing unit. The developing step can be performed with the developing unit. The transfer step can be performed with the transfer unit. The fixing step can be performed with the fixing unit. The other steps can be performed with the other units.

Preferably, the image forming apparatus of the present invention can form (print out) an image on 60 or more A4-size recording media (paper) per minute.

Also, the image forming method used in the present invention is suitably used for a full-color image forming method, and preferably employs a tandem electrophotographic image forming process.

<Latent Electrostatic Image Bearing Member>

The material, shape, structure and size of the latent electrostatic image bearing member (hereinafter may be referred to as "electrophotographic photoconductor" or "photoconductor") are not particularly limited and may be appropriately selected from those known in the art. Regarding the shape, the latent electrostatic image bearing member is suitably in the form of a drum. Regarding the material, the latent electrostatic image bearing member is, for example, an inorganic photoconductor made of amorphous silicon or selenium and an organic photoconductor made of polysilane or phthalopolymethine. Of these, an amorphous silicon photoconductor is preferred since it has a long service life.

The amorphous silicon photoconductor may be, for example, a photoconductor having a support and a photoconductive layer of a-Si, which is formed on the support heated to 50° C. to 400° C. with a film forming method such as vacuum vapor deposition, sputtering, ion plating, thermal CVD, photo-CVD or plasma CVD (hereinafter this photoconductor may be referred to as "a-Si photoconductor"). Of these, plasma CVD is suitably employed, in which gaseous raw materials are decomposed through application of direct current or high-frequency or microwave glow discharge to form an a-Si deposition film on the support.

<Charging Step and Charging Unit>

The charging step is a step of charging a surface of the latent electrostatic image bearing member and is performed with the charging unit.

The above charging can be performed by, for example, applying voltage to the surface of the latent electrostatic image bearing member using a charging device (unit).

The charging device (unit) is not particularly limited and may be appropriately selected depending on the intended purpose. Examples thereof include contact-type chargers known per se having, for example, an electroconductive or semi-electroconductive roller, brush, film and rubber blade; and non-contact-type chargers utilizing colona discharge such as corotron and scorotron.

The charging unit may have any shape like a charging roller as well as a magnetic brush or a fur brush. The shape thereof may be suitably selected according to the specification or configuration of an electrophotographic image forming apparatus.

The charging device is not limited to the aforementioned contact-type charging devices. However, the contact-type charging devices are preferably used from the viewpoint of producing an image forming apparatus in which the amount of ozone generated from the charging device is reduced.

The charging device is preferably a charging device which superposingly applying direct current and alternative voltage to the latent electrostatic image bearing member to thereby charge a surface of the latent electrostatic image bearing member in a state of being disposed so as to be contact or non-contact with the latent electrostatic image bearing member.

<<Fur Brush Charging Unit>>

The charging unit used in the present invention may have any shape like a roller charging unit as well as a magnetic brush charging unit or a fur brush charging unit. The shape thereof may be suitably selected according to the specification or configuration of an electrophotographic apparatus. When the magnetic brush charging unit is used as the charging unit, its magnetic brush is composed of a charging means of various ferrite particles such as Zn—Cu ferrite, a non-magnetic electroconductive sleeve to hold the ferrite particles, and a magnetic roller included in the non-magnetic electroconductive sleeve. Also, when the fur brush charging unit is used as the charging unit, the fur brush may be a fur which is treated to be electroconductive with, for example, carbon, copper sulfide, a metal or a metal oxide as well as which is coiled around or mounted to a metal or a metal core treated to be electroconductive.

Figure 2:
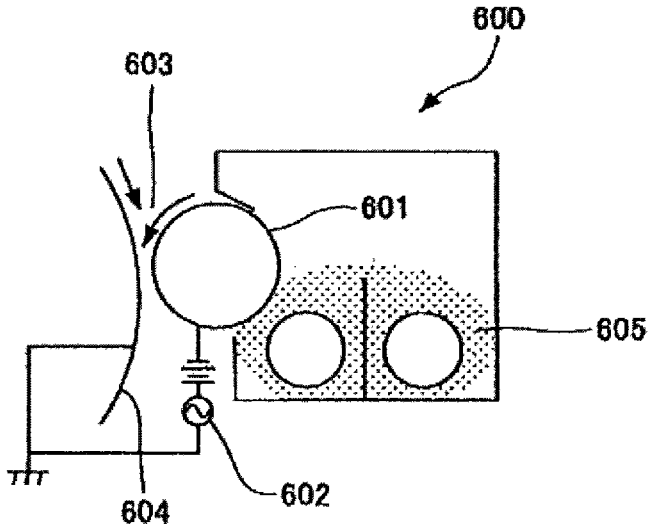
FIG. 2 illustrates one exemplary developing unit in an image forming apparatus of the present invention.

The schematic configuration of one example of a contact-type brush charging unit 510 is illustrated in FIG. 1. A photoconductor 515 to be charged (image bearing member) is rotated at a predetermined speed (process speed) in the direction indicated by the arrow in FIG. 2. A fur brush roller 511 formed of fur brushes is brought into contact with the photoconductor 515 at a predetermined nip width and at a predetermined pressure with respect to elasticity of a brush part 513.

The brush is of preferably 3 denier to 10 denier per fiber, 10 filaments to 100 filaments per bundle, and 80 fibers to 600 fibers per square millimeter. The length of the fur is preferably 1 mm to 10 mm.

The fur brush roller 511 is rotated in the opposite (counter) direction to the rotation direction of the photoconductor 515 at a predetermined peripheral speed (speed of the surface), and comes into contact with a surface of the photoconductor with a difference in velocity. A power supply 514 applies a predetermined charging voltage to the fur brush roller 511 so that the rotating surface of the photoconductor is uniformly charged in a contact manner at a predetermined polarity and potential.

In contact charge of the photoconductor 515 by the fur brush roller 511, charges are mainly directly injected and the rotating surface of the photoconductor is charged at a substantially equal voltage to the charging voltage applied to the fur brush roller 511.

<Light-Exposing Step and Light-Exposing Unit>

The light-exposing step is a step of exposing the charged surface of the latent electrostatic image bearing member to light and is performed with the light-exposing unit.

The light exposure can be performed, for example, by imagewise exposing the surface of the latent electrostatic image bearing member to light using an exposing unit.

The optical system in the light exposure is roughly classified into an analog optical system and a digital optical system. The analog optical system is an optical system in which a manuscript is directly projected on a latent electrostatic image bearing member, while the digital optical system is an optical system in which image information is given as electrical signals and the electrical signals are converted into light signals, to which an electrostatic image bearing member is exposed for forming an image.

The light-exposing unit is not particularly limited and may be appropriately selected depending on the intended purpose so long as the surface of the latent electrostatic image bearing member charged by the charging unit can be imagewise exposed to light. Examples thereof include various light exposing devices such as copying optical systems, rod lens array systems, laser optical systems, liquid crystal shutter optical systems and LED optical systems.

In the present invention, a back-surface-light-exposing system capable of imagewise exposing from the back side of the latent electrostatic image bearing member may be employed.

<Developing Step and Developing Unit>

The developing step is a step of developing the latent electrostatic image with the toner or developer of the present invention to from a visible image.

The visible image can be formed by, for example, developing the latent electrostatic image with the toner or developer and can be formed with the developing unit.

The developing unit is not particularly limited and may be appropriately selected from known developing units as long as it can perform development using the toner or developer of the present invention. Suitable examples thereof include a developing unit which contains the toner or developer of the present invention and can apply the toner or developer to the latent electrostatic image with or without coming into contact with the latent electrostatic image bearing member. More preferred is a developing device containing a toner accommodating container of the present invention.

The above developing device may employ a dry or wet developing process, and may be a single-color or multi-color developing device.

In the developing device, toner particles and carrier particles are stirred and mixed so that the toner particles are charged by friction generated therebetween. The charged toner particles are retained in the chain-like form on the surface of the rotating magnetic roller to form a magnetic brush. The magnetic roller is disposed proximately to the latent electrostatic image bearing member and thus, some of the toner particles forming the magnetic brush on the magnet roller are transferred onto the surface of the latent electrostatic image bearing member by the action of electrically attractive force. As a result, the latent electrostatic image is developed with the toner particles to form a visual toner image on the surface of the latent electrostatic image bearing member.

A developer to be accommodated in the developing device contains the toner of the present invention. The developer may be a one-component developer or a two-component developer. The toner contained in the developer is the toner of the present invention.

Here, in developing the latent image on the photoconductor in the present invention, an alternating electrical field is preferably applied. In a developing device 600 illustrated in FIG. 2 as the developing unit, a power supply 602 applies a vibration bias voltage as developing bias, in which a direct-current voltage and an alternating voltage are superimposed, to a developing sleeve 601 during development. The potential of background part and the potential of image part are positioned between the maximum and the minimum of the vibration bias potential. This forms an alternating electrical field, whose direction alternately changes, at a developing region 603. The toner particles and the carrier particles in the developer are intensively vibrated in this alternating electrical field, so that the toner particles 605 overshoot the electrostatic force of constraint from the developing sleeve 601 and the carrier particles, and are attached to a latent image on the photoconductor 604. Notably, the toner particles 605 are the toner of the present invention.

When the vibration bias voltage is a rectangular wave, it is preferred that a duty ratio is 50% or less. The duty ratio is a ratio of time when the toner leaps to the photoconductor during a cycle of the vibration bias. In this way, the difference between the peak time value when the toner leaps to the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor and the time average value of bias can be decreased. Consequently the movement of the carrier can be restrained and the possibility of the carrier deposition on the background is largely reduced.

<Transfer Step and Transfer Unit>

The transfer step is a step of transferring the visible image onto the recording medium. In a preferred embodiment, visible images are primarily transferred onto an intermediate transfer medium, from which the visible image is secondarily transferred onto the recording medium. In a more preferred embodiment, two or more color toners, preferably a full-color toner, are used, and visible images are transferred onto an intermediate transfer medium to form a composite transfer image (primarily transfer step) and the composite transfer image is transferred onto a recording medium (secondarily transfer step).

The transfer can be performed by, for example, charging the visible image on the latent electrostatic image bearing member using a transfer charger, and can be performed with the transfer unit.

The intermediate transfer medium is not particularly limited and may be appropriately selected from known transfer media. Suitable examples thereof include a transfer belt.

The transfer unit (a primary transfer unit and a secondary transfer unit) preferably contains at least a transfer device which transfers the visible images formed on the latent electrostatic image bearing member onto the recording medium through charging. The number of the transfer units may be one or more. Notably, the recording medium is typically plane paper, but it is not particularly limited and may be appropriately selected depending on the intended purpose so long as it can receive an unfixed image after developing. PET bases for OHP can also be used as the recording medium.

The intermediate transfer belt (one exemplary intermediate transfer medium) will next be described. The intermediate transfer belt is preferably a resin layer having a single-layered structure. If necessary, the intermediate transfer belt may further contain an elastic layer and a surface layer.

The resin material forming the resin layer is not particularly limited and may be appropriately selected depending on the intended purpose. Examples thereof include polycarbonates, styrene-butadiene copolymers, styrene-vinyl chloride copolymers and styrene-vinyl acetate copolymers. These may be used alone or in combination.

The elastic materials (elastic rubbers, elastomers) forming the elastic layer are not particularly limited and may be appropriately selected depending on the intended purpose. Examples thereof include butyl rubber and fluorine-containing rubber. These rubbers may be used alone or in combination.

The material used for the surface layer is not particularly limited and may be appropriately selected depending on the intended purpose, but is required to reduce the adhesion force of toner particles to the surface of the intermediate transfer belt so as to improve the secondary transfer property. Examples thereof include a material containing one or more of polyurethane, polyester and an epoxy resin and reducing surface energy to enhance lubrication. Examples of such a material include: powders of, for example, fluorine resin, fluorine compounds, carbon fluoride, titanium dioxide and silicon carbide; and dispersions of one or more kinds of particles or particles having different particle diameters.

An electroconductive agent for adjusting resistance is added to the resin layer and the elastic layer. The electroconductive agent for adjusting resistance is not particularly limited and may be appropriately selected depending on the intended purpose. Examples thereof include carbon black, graphite, metal powders such as aluminum and nickel; electroconductive metal oxides such as tin oxide, titanium oxide, antimony oxide and potassium titanate.

<Fixing Step and Fixing Unit>

The fixing step is a step of fixing a toner image transferred onto a recording medium and can be performed with the fixing unit. Notably, when two or more color toners are used, fixing may be performed every time an image of each color toner is transferred onto a recording medium, or may be performed after images of all the color toners have been superposed on top of one another on a recording medium. The fixing unit is not particularly limited and may employ a heat-fixing manner using a known heating and pressing unit.

Figure 3:
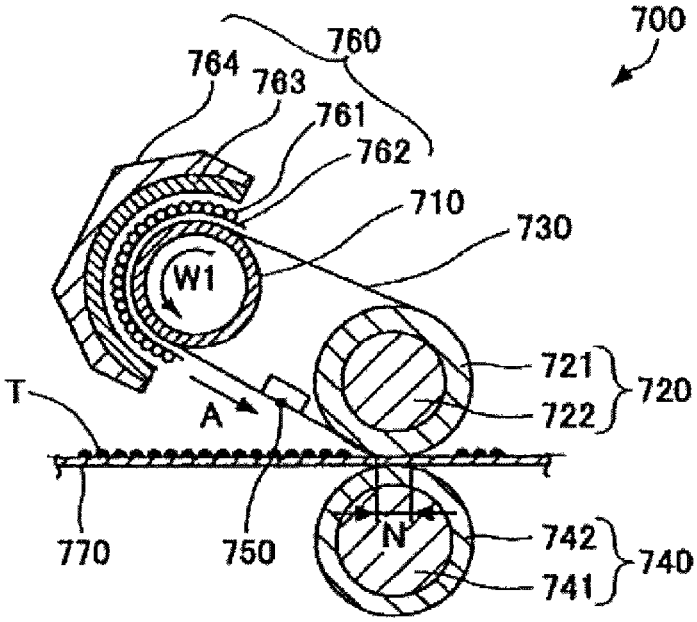
FIG. 3 illustrates one exemplary fixing unit in an image forming apparatus of the present invention.

Here, the fixing unit may be, for example, a fixing unit illustrated in FIG. 3. The fixing unit illustrated in FIG. 3 includes: a heating roller 710 which is heated by electromagnetic induction by means of an induction heating unit 760; a fixing roller 720 (facing rotator) disposed in parallel to the heating roller 710; an endless fixing belt (heat resistant belt, toner heating medium) 730 which is stretched between the heating roller 710 and the fixing roller 720 and which is heated by the heating roller 710 and rotated by any of these rollers in the direction indicated by arrow A; and a pressure roller 740 (pressing rotator) which is pressed against the fixing roller 720 through the fixing belt 730 and which is rotated in forward direction with respect to the fixing belt 730.

The fixing roller 720 (facing rotator) is formed of a metal core 721 made of metal such as stainless steel, and an elastic member 722 made of a solid or foam-like silicone rubber having heat resistance to be coated on the metal core 721.

The fixing belt 730 that is stretched between the heating roller 710 and the fixing roller 720 is heated at a contact section W1 with the heating roller 710 to be heated by the induction heating unit 760. Then, an inner surface of the fixing belt 730 is continuously heated by the rotation of the heating roller 710 and the fixing roller 720, and as a result, the whole belt will be heated.

The pressure roller 740 is constructed of a cylindrical metal core 741 made of a metal having a high thermal conductivity, for example, copper or aluminum, and an elastic member 742 having a high heat resistance and toner releasing property that is located on the surface of the metal core 741. The metal core 741 may be made of SUS other than the above-described metals.

The induction heating unit 760 for heating the heating roller 710 by electromagnetic induction, as illustrated in FIG. 3, includes an exciting coil 761 serving as a field generation unit, and a coil guide plate 762 around which this exciting coil 761 is wound. The coil guide plate 762 has a semi-cylindrical shape that is located close to the perimeter surface of the heating roller 710. The exciting coil 761 is the one in which one long exciting coil wire is wound alternately in an axial direction of the heating roller 710 along this coil guide plate 762.

<Other Steps and Other Units>

—Charge-Eliminating Step and Charge-Eliminating Unit—

The charge-eliminating step is a step of applying charge-eliminating bias to the latent electrostatic image bearing member to thereby eliminate changes thereof and can suitably performed with a charge-eliminating unit.

The charge-eliminating unit is not particularly limited and may be appropriately selected from known charge-eliminating devices so long as it can apply charge-eliminating bias to the latent electrostatic image bearing member. Examples thereof include a charge-eliminating lamp.

—Cleaning Step and Cleaning Unit—

The cleaning step is a step of removing the toner remaining on the latent electrostatic image bearing member and can suitably be performed with a cleaning unit.

The cleaning unit is not particularly limited and may be appropriately selected from known cleaners so long as it can remove the electrophotographic toner remaining on the latent electrostatic image bearing member. Suitable examples thereof include a magnetic brush cleaner and a blade cleaner.

<Recycling Step and Recycling Unit>

The recycling step is a step of recycling the toner removed in the cleaning step to developing unit and can suitably be performed with a recycling unit.

The recycling unit is not particularly limited and may be, for example, a known conveying unit.

<Controlling Step and Controlling Unit>

The controlling step is a step of controlling each of the above steps and can suitably be performed with a controlling unit.

The controlling unit is not particularly limited and may be appropriately selected depending on the intended purpose so long as it can control the operation of each unit. Examples thereof include devices such as a sequencer and a computer.

<Full-Color Image Forming Method and Image Forming Apparatus>

Figure 4:
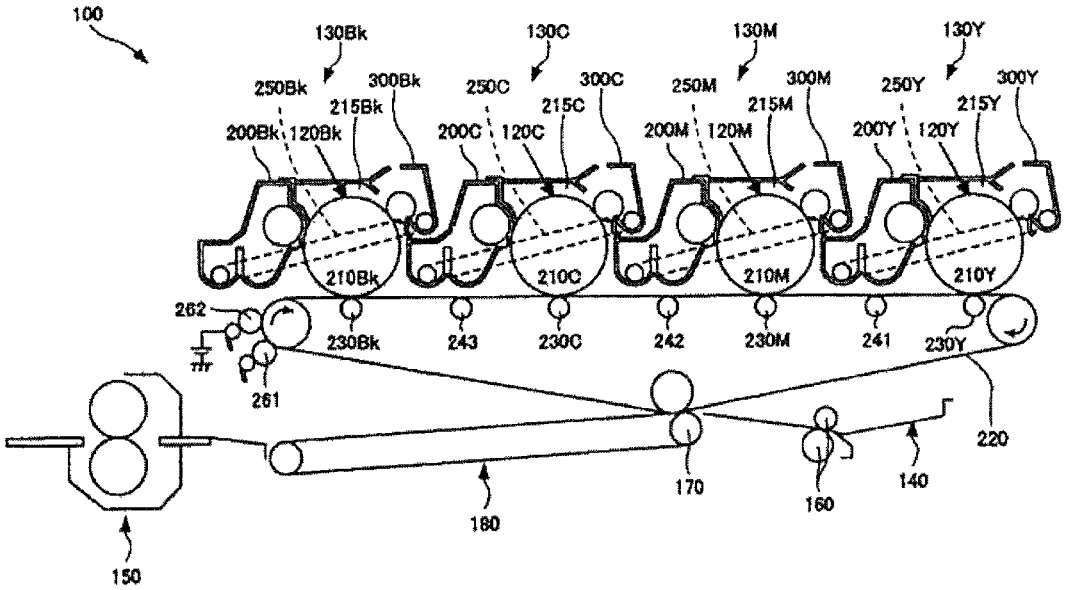
FIG. 4 schematically illustrates one exemplary image forming apparatus of the present invention.

A full-color image forming apparatus as the image forming apparatus of the present invention may be, for example, a tandem image forming apparatus 100 illustrated in FIG. 4.

In FIG. 4, the image forming apparatus 100 mainly includes image writing units (120Bk, 120C, 120M and 120Y) for color image formation by an electrophotographic method, image forming units (130Bk, 130C, 130M and 130Y), and a paper feeder 140. According to image signals, image processing is performed in an image processing unit for conversion to respective color signals of black (Bk), cyan (C), magenta (M), and yellow (Y) for image formation, and the color signals are sent to the image wiring units (120Bk, 120C, 120M and 120Y). The image writing units (120Bk, 120C, 120M and 120Y) are a laser scanning optical system that includes, for example, a laser beam source, a deflector such as a rotary polygon meter, a scanning imaging optical system, and a group of mirrors, has four writing optical paths corresponding to the color signals, and performs image writing according to the color signals in the image forming units (130Bk, 130C, 130M and 130Y).

The image forming units (130Bk, 130C, 130M and 130Y) include photoconductors (210Bk, 210C, 210M and 210Y) respectively for black, cyan, magenta, and yellow. An organic photoconductor (OPC) photoconductor is generally used in the photoconductors (210Bk, 210C, 210M and 210Y) for the respective colors. For example, chargers (215Bk, 215C, 215M and 215Y), an exposing unit for laser beams emitted from the image writing units (120Bk, 120C, 120M and 120Y), developing devices (200Bk, 200C, 200M and 200Y) for respective colors, primary transfer devices (230Bk, 230C, 230M and 230Y), cleaning devices (300Bk, 300C, 300M and 300Y), and charge-eliminating devices are provided around the respective photoconductors (210Bk, 210C, 210M and 210Y). The developing devices (200Bk, 200C, 200M and 200Y) use a two-component magnetic brush development system. Further, an intermediate transfer belt 220 is interposed between the photoconductors (210Bk, 210C, 210M and 210Y) and the primary transfer devices (230Bk, 230C, 230M and 230Y). Color toner images are successively transferred from respective photoconductors onto the intermediate transfer belt 220 to form superimposed toner images that are supported by the intermediate transfer belt 220.

Electroconductive rollers 241, 242 and 243 are provided between the primary transfer devices (230Bk, 230C, 230M and 230Y). The transfer paper is fed from a paper feeder 140 and then is supported on a transfer belt 180 through a pair of registration rollers 160. At a portion where the intermediate transfer belt 220 comes into contact with the transfer belt 180, the toner images on the intermediate transfer belt 220 are transferred by a secondary transfer roller 170 onto the transfer paper to perform color image formation.

The transfer paper after image formation is transferred by a secondary transfer belt 180 to a fixing device 150 where the color image is fixed to provide a fixed color image. The toner remaining after transfer on the intermediate transfer belt 220 is removed form the belt by an intermediate transfer belt cleaning device.

Next, the photoconductor cleaning unit will be described in detail. In FIG. 4, the developing units (200Bk, 200C, 200M and 200Y) are connected to respective cleaning devices (300Bk, 300C, 300M and 300Y) through toner transfer tubes (250Bk, 250C, 250M and 250Y) (dashed lines in FIG. 4). A screw is provided within the toner transfer tubes (250Bk, 250C, 250M and 250Y), and the toners recovered in the cleaning units (300Bk, 300C, 300M and 300Y) are transferred to the respective developing units (200Bk, 200C, 200M and 200Y).

By contrast, in the full-color image forming apparatus, since the intermediate transfer belt 220 is used, the contamination with paper dust is not significant. Further, the adherence of paper dust onto the intermediate transfer belt 220 during the transfer onto the paper can also be prevented. Since each of the photoconductors (210Bk, 210C, 210M and 210Y) uses independent respective color toners, there is no need to perform contacting and separating of the photoconductor cleaning devices (300Bk, 300C, 300M and 300Y). Accordingly, only the toner can be reliably recovered. The positively charged toner remaining after transfer on the intermediate transfer belt 220 is removed by cleaning with an electroconductive fur brush 262 to which a negative voltage has been applied. A voltage can be applied to the electroconductive fur brush 262 in the same manner as in the application of the voltage to an electroconductive fur brush 261, except that the polarity is different. The toner remaining after transfer can be almost completely removed by cleaning with the two electroconductive fur brushes 261 and 262. The toner, paper dust, talc and the like, remaining unremoved by cleaning with the electroconductive fur brush 262 are negatively charged by a negative voltage of the electroconductive fur brush 262. The subsequent primary transfer of black is transfer by a positive voltage. Accordingly, the negatively charged toner and the like are attracted toward the intermediate transfer belt 220, and, thus, the transfer to the photoconductor (black) (210Bk) side can be prevented.

<Process Cartridge>

A process cartridge used in the present invention contains at least a latent electrostatic image bearing member configured to bear a latent electrostatic image and a developing unit configured to develop the latent electrostatic image on the latent electrostatic image bearing member with the toner of the present invention to thereby form a visible image; and, if necessary, further contains appropriately selected other units such as a charging unit, a developing unit, a transfer unit, a cleaning unit and a charge-eliminating unit. The process cartridge is detachably mountable to a main body of the image forming apparatus.

The developing unit contains at least a developer container which accommodates the toner or developer of the present invention and a developer bearing member configured to bear and convey the toner or developer accommodated in the developer container; and may further contain other members such as a layer thickness-regulating member configured to regulating the thickness of a toner layer. The process cartridge of the present invention is detachably mountable to various electrophotographic image forming apparatus, facsimiles and printers. Preferably, it is detachably mounted to the image forming apparatus of the present invention.

EXAMPLES

The present invention will next be described by way of Examples, which should not be construed as limiting the present invention thereto.

<Measurement of Molecular Weight of Resin>

The molecular weight was measured through gel permeation chromatography (GPC). Specifically, a column was conditioned in a heat chamber of 40° C. Then, tetrahydrofuran (THF) serving as a solvent was caused to pass through the column at a flow rate of 1 mL/min at the same temperature. Subsequently, a separately prepared THF solution of a resin sample (concentration; 0.05% by mass to 0.6% by mass) was applied to the column in an amount of 50 μL to 200 μL.

In the measurement of the molecular weight of the sample, the molecular weight distribution was determined based on the relationship between the logarithmic value and the count number of a calibration curve given by using several monodisperse polystyrene-standard samples. The standard polystyrenes used for giving the calibration curve were those available from Pressure Chemical Co. or Tosoh Co.; i.e., those each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. Properly, at least about 10 standard polystyrene samples are used for giving the calibration curve. The detector used was a refractive index (RI) detector.

<Measurement of Melting Point and Glass Transition Temperature>

The melting point of the releasing agent, the melting point of the crystalline resin and the glass transition temperature of the non-crystalline resin were measured from a DSC curve obtained through differential scanning calorimetry (DSC). Specifically, the DSC curve was obtained using TA-60WS and DSC-60 (these products are of Shimadzu Corporation) under the following measurement conditions.

[Measurement Conditions]

Sample container: aluminum sample pan (with a lid)
Sample amount: 5 mg
Reference: aluminum sample pan (alumina: 10 mg)
Atmosphere: nitrogen (flow rate: 50 mL/min)
Temperature condition:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

The measured results were analyzed using data analysis software TA-60, version 1.52 (product of Shimadzu Corporation).

The analysis was performed by appointing a range of ±5° C. around a point presenting the maximum peak of a DrDSC curve, which was a differential curve of the DSC curve in the second heating, and by determining the peak temperature using a peak analysis function of the data analysis software. Then, the maximum endothermic temperature of the DSC curve was determined in the range of the peak temperatures +5° C. and −5° C. in the DSC curve using the peak analysis function of the data analysis software. The temperature presented here corresponds to the melting point of the sample.

The glass transition temperature (Tg) was defined as an intersection point between the DSC curve and a straight line, which passed through an intermediate point between baselines before and after appearance of the exothermic peak of the main peak in the temperature range of 40° C. to 100° C. in the heating.

<Measurement of Storage Modulus and Loss Modulus of Toner>

One gram of a toner was molded with a press mold at room temperature (about 23° C.) and a pressure of 150 kg/cm$^2$ for 5 min, to thereby prepare a measurement sample having a diameter of 20 mm and a thickness of 2 mm.

Using a rotary flat-type rheometer (product of Rheometrics, Co.), a strain of 20% or less was applied to the thus-prepared measurement sample at a frequency of 1 Hz using parallel plates each having a diameter of 20 mm. In this state, the sample was heated at a heating rate of 1° C./min from 70° C. to 150° C., to thereby measure the storage modulus and the loss modulus of the sample; i.e., storage modulus G1 at 80° C. in the heating, loss modulus G2 at 80° C. in the heating, and storage modulus G5 at 120° C. in the heating. After heated to 150° C., the sample was cooled from 150° C. to 70° C. at a cooling rate of 1° C./min, to thereby measure the storage modulus and the loss modulus of the sample; i.e., storage modulus G3 at 80° C. in the cooling and loss modulus G4 at 80° C. in the cooling.

<Distribution of the Numbers of Carbon Atoms of Ester Wax>

The distribution of the numbers of carbon atoms of the ester wax was measured using a gas chromatography apparatus equipped with a capillary column (TGA apparatus model Q5000IR, product of TA Instruments of high-sensitive TGA). Specifically, the percentage of the ester compounds having 44 or more carbon atoms in the ester wax was obtained by calculating the percentage of a peak area of linear monoester compounds having 44 or more carbon atoms relative to the sum of peak areas of the ester wax on the gas chromatogram chart.

(Synthesis Example 1 of Non-Crystalline Polyester

—Synthesis of Non-Crystalline Polyester (Unmodified Polyester) 1—

A reaction container equipped with a condenser, a stirring and a nitrogen-introducing tube was charged with 781 parts by mass of bisphenol A propylene oxide 3 mole adduct, 218 parts by mass of terephthalic acid, 48 parts by mass of adipic acid, and 2 parts by mass of dibutyltin oxide. The resultant mixture was allowed to react under normal pressure at 230° C. for 8 hours, and further react at a reduced pressure of 10 mmHg to 15 mmHg for 5 hours. Then, 45 parts by mass of trimellitic anhydride was added to the reaction container, and the reaction mixture was allowed to react under normal pressure at 180° C. for 2 hours, to thereby obtain [non-crystalline polyester 1].

The obtained [non-crystalline polyester 1] was found to have a number average molecular weight of 1,900, a weight average molecular weight of 4,400, a glass transition temperature (Tg) of 43° C. and an acid value of 25 mgKOH/g.

(Synthesis Example 2 of Non-Crystalline Polyester)

—Synthesis of Non-Crystalline Polyester (Unmodified Polyester) 2—

[Non-crystalline polyester 2] was synthesized in the same manner as in Synthesis Example 1 of non-crystalline polyester except that the period of the reaction performed under normal pressure at 180° C. after the addition of 45 parts by mass of trimellitic anhydride was changed to 1 hour.

The obtained [non-crystalline polyester 2] was found to have a number average molecular weight of 1,300, a weight average molecular weight of 3,400, a glass transition temperature (Tg) of 32° C. and an acid value of 28 mgKOH/g.

(Synthesis Example 3 of Non-Crystalline Polyester

—Synthesis of Non-Crystalline Polyester (Unmodified Polyester) 3—

[Non-crystalline polyester 3] was synthesized in the same manner as in Synthesis Example 1 of non-crystalline polyester except that the period of the reaction performed under normal pressure at 180° C. after the addition of 45 parts by mass of trimellitic anhydride was changed to 4 hours.

The obtained [non-crystalline polyester 3] was found to have a number average molecular weight of 2,900, a weight average molecular weight of 6,800, a glass transition temperature (Tg) of 64° C. and an acid value of 17 mgKOH/g.

(Synthesis Example 4 of non-crystalline polyester)

—Synthesis of Non-Crystalline Polyester (Unmodified Polyester) 4—

[Non-crystalline polyester 4] was synthesized in the same manner as in Synthesis Example 1 of non-crystalline polyester except that the amount of terephthalic acid charged was changed to 167 parts by mass and the amount of adipic acid charged was changed to 91 parts by mass.

The obtained [non-crystalline polyester 4] was found to have a number average molecular weight of 1,300, a weight average molecular weight of 5,600, a glass transition temperature (Tg) of 49° C. and an acid value of 23 mgKOH/g.

TABLE 1

| | Number average molecular weight | Weight average molecular weight | Glass transition temperature | Acid value |
|---|---|---|---|---|
| Non-crystalline polyester 1 | 1,900 | 4,400 | 43° C. | 25 mgKOH/g |
| Non-crystalline polyester 2 | 1,300 | 3,400 | 32° C. | 28 mgKOH/g |
| Non-crystalline polyester 3 | 2,900 | 6,800 | 64° C. | 17 mgKOH/g |
| Non-crystalline polyester 4 | 1,300 | 5,600 | 49° C. | 23 mgKOH/g |

(Synthesis Example 1 of Crystalline Polyester)

—Synthesis of Crystalline Polyester 1—

A 5 L four-necked flask equipped with a nitrogen-introducing tube, a dehydration tube, a stirrer and a thermocouple was charged with 1,260 g of 1,6-butanediol, 120 g of ethylene glycol, 1,400 g of fumaric acid, 350 g of trimellitic anhydride, 3.5 g of tin octylate and 1.5 g of hydroquinone. The resultant mixture was allowed to react at 160° C. for 5 hours. Then, the reaction mixture was allowed to react at 200° C. for 1 hour and further react at 8.3 kPa for 1 hour, to thereby synthesize [crystalline polyester 1].

The obtained [crystalline polyester 1] was found to have a weight average molecular weight of 13,000, a number average molecular weight of 3,600 and a melting point of 79° C.

(Synthesis Example 2 of Crystalline Polyester

—Synthesis of Crystalline Polyester 2—

[Crystalline polyester 2] was synthesized in the same manner as in Synthesis Example 1 of crystalline polyester except that the same materials of the same amounts were charged to the four-necked flask and the resultant mixture was allowed to react at 160° C. for 3 hours and then the reaction mixture was allowed to react at 200° C. for 1 hour and further react at 8.3 kPa for 0.5 hours.

The obtained [crystalline polyester 2] was found to have a weight average molecular weight of 10,000, a number average molecular weight of 3,100 and a melting point of 54° C.

(Synthesis Example 3 of Crystalline Polyester)

—Synthesis of Crystalline Polyester 3—

A 5 L four-necked flask equipped with a nitrogen-introducing tube, a dehydration tube, a stirrer and a thermocouple was charged with 1,260 g of 1,6-butanediol, 120 g of ethylene glycol, 1,760 g of adipic acid, 350 g of trimellitic anhydride, 3.5 g of tin octylate and 1.5 g of hydroquinone. The resultant mixture was allowed to react at 160° C. for 7 hours. Then, the reaction mixture was allowed to react at 200° C. for 2 hours, to thereby synthesize [crystalline polyester 3].

The obtained [crystalline polyester 3] was found to have a weight average molecular weight of 7,000, a number average molecular weight of 1,100 and a melting point of 119° C.

(Synthesis Example 4 of Crystalline Polyester)

—Synthesis of Crystalline Polyester 4—

[Crystalline polyester 4] was synthesized in the same manner as in Synthesis Example 3 of crystalline polyester except that the same materials of the same amounts were charged to the four-necked flask and the resultant mixture was allowed to react at 160° C. for 7 hours and then the reaction mixture was allowed to react at 200° C. for 2 hours and further react at 8.3 kPa for 1 hour.

The obtained [crystalline polyester 4] was found to have a weight average molecular weight of 16,000, a number average molecular weight of 2,500 and a melting point of 142° C.

(Synthesis Example 5 of Crystalline Polyester)

—Synthesis of Crystalline Polyester 5—

[Crystalline polyester 5] was synthesized in the same manner as in Synthesis Example 1 of crystalline polyester except that the same materials of the same amounts were charged to the four-necked flask and the resultant mixture was allowed to react at 160° C. for 5 hours and then the reaction mixture was allowed to react at 200° C. for 2 hours.

The obtained [crystalline polyester 5] was found to have a weight average molecular weight of 5,500, a number average molecular weight of 900 and a melting point of 41° C.

TABLE 2

| | Weight average molecular weight | Number average molecular weight | Melting point |
|---|---|---|---|
| Crystalline polyester 1 | 13,000 | 3,600 | 79° C. |
| Crystalline polyester 2 | 10,000 | 3,100 | 54° C. |
| Crystalline polyester 3 | 7,000 | 1,100 | 119° C. |
| Crystalline polyester 4 | 16,000 | 2,500 | 142° C. |
| Crystalline polyester 5 | 5,500 | 900 | 41° C. |

(Synthesis Example 1 of Prepolymer)

—Synthesis of Prepolymer 1—

A reaction container equipped with a condenser, a stirrer and a nitrogen-introducing tube was charged with 682 parts by mass of bisphenol A ethylene oxide 2 mole adduct, 81 parts by mass of bisphenol A propylene oxide 2 mole adduct, 283 parts by mass of terephthalic acid, 22 parts by mass of trimellitic anhydride and 2 parts by mass of dibutyltin oxide. The resultant mixture was allowed to react under normal pressure for 8 hours at 230° C. and then further react at a reduced pressure of 10 mmHg to 15 mmHg for 5 hours, to thereby obtain [Intermediate polyester 1].

The obtained [intermediate polyester 1] was found to have a number average molecular weight of 7,200, a weight average molecular weight of 28,500, a glass transition temperature (Tg) of 45° C., an acid value of 0.5 mgKOH/g and a hydroxyl group value of 49 mgKOH/g.

Next, a reaction container equipped with a condenser, a stirrer and a nitrogen-introducing tube was charged with 411 parts by mass of the [intermediate polyester 1], 89 parts by mass of isophoron diisocyanate and 500 parts by mass of ethyl acetate. The resultant mixture was allowed to react at 100° C. for 5 hours, to thereby obtain [prepolymer 1].

(Synthesis Example 2 of Prepolymer

—Synthesis of Prepolymer 2—

[Intermediate polyester 2] was synthesized in the same manner as in the synthesis of the [intermediate polyester 1] except that the period of the reaction performed at a reduced pressure of 10 mmHg to 15 mmHg was changed to 3 hours.

The obtained [intermediate polyester 2] was found to have a number average molecular weight of 6,200, a weight average molecular weight of 18,600, a glass transition temperature (Tg) of 45° C., an acid value of 2.4 mgKOH/g and a hydroxyl value of 46 mgKOH/g.

Next, a reaction container equipped with a condenser, a stirrer and a nitrogen-introducing tube was charged with 411 parts by mass of the [intermediate polyester 2], 89 parts by mass of isophoron diisocyanate and 500 parts by mass of ethyl acetate. The resultant mixture was allowed to react at 100° C. for 5 hours, to thereby obtain [prepolymer 2].

(Synthesis Example 3 of Prepolymer)

—Synthesis of Prepolymer 3—

[Intermediate polyester 3] was synthesized in the same manner as in the synthesis of the [intermediate polyester 1] except that the period of the reaction performed at a reduced pressure of 10 mmHg to 15 mmHg was changed to 6.5 hours.

The obtained [intermediate polyester 3] was found to have a number average molecular weight of 8,900, a weight average molecular weight of 41,700, a glass transition temperature (Tg) of 57° C., an acid value of 0.3 mgKOH/g and a hydroxyl value of 49 mgKOH/g.

Next, a reaction container equipped with a condenser, a stirrer and a nitrogen-introducing tube was charged with 411 parts by mass of the [intermediate polyester 3], 89 parts by mass of isophoron diisocyanate and 500 parts by mass of ethyl acetate. The resultant mixture was allowed to react at 100° C. for 5 hours, to thereby obtain [prepolymer 3].

Ethyl acetate was added to each prepolymer to adjust its solid content concentration to 40% by mass.

(Synthesis Example 1 of Ester Wax)

—Synthesis of Ester Wax 1—

A four-necked flask reaction apparatus equipped with a Dimroth condenser and a Dean-Stark water separator was charged with 1,740 parts by mass of benzene, 1,300 parts by mass of long-chain alkylcarboxylic acids (stearic acid and behenic acid, molar ratio (stearic acid behenic acid)=80:20), 1,200 parts by mass of a long-chain alkyl alcohol (stearyl alcohol) and 120 parts by mass of p-toluenesulfonic acid. The materials were stirred sufficiently and dissolved, followed by refluxing for 5 hours. Then, the valve of the water separator was opened to perform evaporation by co-boiling. After the evaporation by co-boiling, the mixture was sufficiently washed with sodium hydrogen carbonate and dried to evaporate benzene. The resultant product was recrystallized and then washed and purified, to thereby synthesize [monoester wax 1].

The obtained [monoester wax 1] was found to have a melting point of 66° C., and the percentage of ester compounds having 44 or more carbon atoms in the [monoester wax 1] was found to be 48%.

(Synthesis Examples 2 to 10 of Ester Waxes)

—Synthesis of Ester Waxes 2 to 10—

[Monoester wax 2] to [monoester wax 10] were synthesized in the same manner as in Synthesis Example 1 of ester wax except that the species and amount of the long-chain alkylcarboxylic acids and the species and amount of the long-chain alkyl alcohol were changed as presented in Table 3.

The melting points of the [monoester wax 2] to [monoester wax 10] and the percentages of ester compounds having 44 or more carbon atoms in the [monoester wax 2] to [monoester wax 10] are presented in Table 3, where the numerical values mean molar ratios.

TABLE 3

| | Long-chain alkyl carboxylic acids | | | Long-chain alkyl alcohol | | Melting | Percentages of ester compounds having 44 or |
|---|---|---|---|---|---|---|---|
| | Palmitic acid | Stearic acid | Behenic acid | Steary alcohol | Behenyl alcohol | point (° C.) | more carbon atoms (%) |
| Monoester wax 1 | — | 80 | 20 | 100 | — | 66 | 48 |
| Monoester wax 2 | — | 60 | 40 | 100 | — | 72 | 52 |
| Monoester wax 3 | 10 | 70 | 30 | 100 | 20 | 58 | 46 |
| Monoester wax 4 | — | 40 | 60 | 70 | 30 | 78 | 59 |
| Monoester wax 5 | 30 | 50 | 20 | 100 | — | 56 | 41 |
| Monoester wax 6 | 60 | 20 | 20 | 50 | 50 | 42 | 40 |
| Monoester wax 7 | — | 50 | 50 | — | 100 | 88 | 53 |

TABLE 3-continued

| | Long-chain alkyl carboxylic acids | | | Long-chain alkyl alcohol | | Melting | Percentages of ester compounds having 44 or |
|---|---|---|---|---|---|---|---|
| | Palmitic acid | Stearic acid | Behenic acid | Steary alcohol | Behenyl alcohol | point (° C.) | more carbon atoms (%) |
| Monoester wax 8 | — | 40 | 60 | — | 100 | 80 | 50 |
| Monoester wax 9 | 10 | 40 | 50 | — | 100 | 84 | 51 |
| Monoester wax 10 | 20 | 40 | 40 | 80 | 20 | 51 | 46 |

Example 1

Synthesis of Organic Particle Emulsion

A reaction container equipped with a stirring rod and a thermometer was charged with 683 parts by mass of water, 11 parts by mass of sodium salt of sulfuric acid ester of ethylene oxide adduct of methacrylic acid (ELEMINOL RS-30, product of Sanyo Chemical Industries Ltd.), 138 parts by mass of styrene, 138 parts by mass of methacrylic acid and 1 part by mass of ammonium persulfate. The resultant mixture was stirred at 400 rpm for 15 min to thereby obtain a white emulsion. The white emulsion was heated to a system temperature of 75° C. and was allowed to react for 5 hours. Then, 30 parts by mass of a 1% by mass aqueous ammonium persulfate solution was added to the reaction mixture, followed by aging at 75° C. for 5 hours, to thereby obtain an aqueous dispersion [particle dispersion liquid 1] of a vinyl resin (a copolymer of styrene-methacrylic acid-sodium salt of sulfate ester of methacrylic acid-ethylene oxide adduct).

The volume average particle diameter of the obtained [particle dispersion liquid 1] was found to be 0.14 μm, when measured using a laser diffraction particle size distribution analyzer (LA-920, product of Horiba, Ltd.).

—Preparation of Aqueous Phase—

Water (990 parts by mass), 80 parts by mass of the [particle dispersion liquid 1], 40 parts by mass of a 48.5% by mass aqueous solution of sodium dodecyldiphenyl ether disulfonate (ELEMINOL MON-7, product of Sanyo Chemical Industries Ltd.) and 90 parts by mass of ethyl acetate were stirred and mixed together to thereby obtain a milky white liquid, which was used as [aqueous phase 1].

—Synthesis of Ketimine—

A reaction container equipped with a stirring rod and a thermometer was charged with isophorone diisocyanate (170 parts by mass) and methyl ethyl ketone (75 parts by mass), followed by reaction at 50° C. for 5 hours, to thereby obtain [ketimine compound 1]. The amine value of the obtained [ketimine compound 1] was found to be 418.

—Preparation of Masterbatch—

Carbon black (REGAL 400R, product of Cabot Corporation) (40 parts by mass), 60 parts by mass of a polyester resin (RS-801, product of Sanyo Chemical Industries, Ltd., acid value: 10 mgKOH/g, weight average molecular weight: 20,000, glass transition temperature (Tg): 64° C.) and 30 parts by mass of water were mixed together using HENSCHEL MIXER, to thereby obtain a mixture containing pigment aggregates impregnated with water.

The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

—Preparation of Oil Phase—

A container to which a stirring rod and a thermometer had been set was charged with 500 parts by mass of the [non-crystalline polyester 1], 100 parts by mass of the [monoester wax 1] serving as a releasing agent (the amount in the toner: 7.5% by mass), 500 parts by mass of the [masterbatch 1] and 950 parts by mass of ethyl acetate. The resultant mixture was increased in temperature to 80° C. under stirring and kept at 80° C. for 5 hours and then cooled to 30° C. for 1 hour. Next, the container was charged with 100 parts by mass of the [crystalline polyester 1] (the amount in the toner: 7.5% by mass) and 500 parts by mass of ethyl acetate, followed by mixing for 1 hour, to thereby obtain [raw material solution 1].

The obtained [raw material solution 1] (1,324 parts) was placed in a container and treated with a bead mill (ULTRA VISCOMILL, product of AIMEX CO., Ltd.) under the following conditions: liquid-feeding rate: 1 kg/h; disc circumferential speed: 6 m/sec; the amount of zirconia beads having a particle diameter of 0.5 mm packed: 80% by volume; pass time: 3, whereby [oil phase dispersion liquid 1] was produced.

The solid content concentration of the obtained [oil phase dispersion liquid 1] was found to be 50% by mass (130° C., 30 min).

—Emulsification—

A container was charged with 648 parts by mass of the [oil phase dispersion liquid 1], 80.8 parts by mass of the [prepolymer 1] (the amount in the toner: 10% by mass) and 6.6 parts by mass of the [ketimine compound 1] and the materials were mixed together using a TK homomixer (product of Tokushu Kika Kogyo Co., Ltd.) at 5,000 rpm for 1 min. Then, 1,200 parts by mass of the [aqueous phase 1] was added to the container and the resultant mixture was mixed with the TK homomixer at 13,000 rpm for 3 min, whereby [emulsified slurry 1] was obtained.

—Deformation and Desolvation—

The [emulsified slurry 1] was charged into a container to which a stirrer and a thermometer had been set, and then left to stand still at 15° C. for 1 hour. The [emulsified slurry 1] was desolvated at 30° C. for 1 hour to thereby obtain [dispersion slurry 1].

The obtained [dispersion slurry 1] was found to have a volume average particle diameter of 5.52 μm and a number average particle diameter of 4.74 μm. Notably, the volume average particle diameter and the number average particle diameter of the [dispersion slurry 1] were measured using COULTER MULTISIZER III (product of Nikkaki Co., Ltd.).

—Aging—

The [dispersion slurry 1] was aged at 45° C. for 12 hours in the container where the desolvation had been performed, to thereby obtain [aged slurry 1]. No changes in particle diameter and particle size distribution were found before and after the aging.

—Washing and Drying—

The obtained [aged slurry 1] (100 parts by mass) was filtrated under reduced pressure and then subjected to the following washing and drying treatments.

(1): Ion-exchanged water (100 parts by mass) was added to the filtration cake and the mixture was mixed using a TK homomixer (12,000 rpm, 10 min), followed by filtration.

(2): A 10% by mass aqueous sodium hydroxide solution (100 parts by mass) was added to the filtration cake obtained in (1) and the mixture was mixed using a TK homomixer (12,000 rpm, 30 min) under application of ultrasonic vibration, followed by filtration under reduced pressure. This washing treatment was performed again (twice in total).

(3): 10% by mass hydrochloric acid (100 parts by mass) was added to the filtration cake obtained in (2) and the mixture was mixed using a TK homomixer (12,000 rpm, 10 min), followed by filtration.

(4): Ion-exchanged water (300 parts by mass) was added to the filtration cake obtained in (3) and the mixture was mixed using a TK homomixer (12,000 rpm, 10 min), followed by filtration. This treatment was performed twice in total to thereby obtain [filtration cake 1].

The obtained [filtration cake 1] was dried using an air-circulation dryer at 45° C. for 48 hours and sieved with a mesh having an opening of 75 μm, whereby toner 1 was obtained.

Example 2

Toner 2 was produced in the same manner as in Example 1 except that the amount of the [prepolymer 1] charged was changed to 120 parts by mass (the amount in the toner: 14% by mass).

Example 3

Toner 3 was produced in the same manner as in Example 1 except that the amounts of the materials were adjusted so that the amount of the [crystalline polyester 1] relative to 100 parts by mass of the [non-crystalline polyester 1] was 18 parts by mass (the amount in the toner: 6.8% by mass).

Example 4

Toner 4 was produced in the same manner as in Example 1 except that the amounts of the materials were adjusted so that the amount of the [crystalline polyester 1] relative to 100 parts by mass of the [non-crystalline polyester 1] was 4 parts by mass (the amount in the toner: 1.6% by mass).

Example 5

Toner 5 was produced in the same manner as in Example 1 except that the amount of the [monester wax 1] charged was changed to 135 parts by mass (the amount in the toner: 9.5% by mass).

Example 6

Toner 6 was produced in the same manner as in Example 1 except that the amount of the [monester wax 1] charged was changed to 55 parts by mass (the amount in the toner: 4.0% by mass).

Example 7

Toner 7 was produced in the same manner as in Example 1 except that the [monoester wax 1] was changed to the [monoester wax 2].

Example 8

Toner 8 was produced in the same manner as in Example 1 except that the [monoester wax 1] was changed to the [monoester wax 3].

Example 9

Toner 9 was produced in the same manner as in Example 1 except that the [monoester wax 1] was changed to the [monoester wax 8].

Example 10

Toner 10 was produced in the same manner as in Example 1 except that the amount of the [monoester wax 1] charged was changed to 175 parts by mass (the amount in the toner: 12% by mass).

Example 11

Toner 11 was produced in the same manner as in Example 1 except that the amount of the [monoester wax 1] charged was changed to 20 parts by mass (the amount in the toner: 1.5% by mass).

Example 12

Toner 12 was produced in the same manner as in Example 1 except that the [crystalline polyester 1] was changed to the [crystalline polyester 2].

Example 13

Toner 13 was produced in the same manner as in Example 1 except that the [crystalline polyester 1] was changed to the [crystalline polyester 3].

Example 14

Toner 14 was produced in the same manner as in Example 1 except that the amount of the [crystalline polyester 1] relative to 100 parts by mass of the [non-crystalline polyester 1] was 23 parts by mass (the amount in the toner: 8.5% by mass).

Example 15

Toner 15 was produced in the same manner as in Example 1 except that the amount of the [crystalline polyester 1] relative to 100 parts by mass of the [non-crystalline polyester 1] was 1.5 parts by mass (the amount in the toner: 0.6% by mass).

Example 16

Toner 16 was produced in the same manner as in Example 1 except that the [non-crystalline polyester 1] was changed to the [non-crystalline polyester 2].

Example 17

Toner 17 was produced in the same manner as in Example 1 except that the [non-crystalline polyester 1] was changed to the [non-crystalline polyester 3].

Example 18

Toner 18 was produced in the same manner as in Example 1 except that the [non-crystalline polyester 1] was changed to the [non-crystalline polyester 4].

Example 19

Toner 19 was produced in the same manner as in Example 1 except that the [prepolymer 1] was changed to the [prepolymer 2].

Example 20

Toner 20 was produced in the same manner as in Example 1 except that the [prepolymer 1] was changed to the [prepolymer 3].

Example 21

Toner 21 was produced in the same manner as in Example 1 except that the amount of the [prepolymer 1] charged was changed to 150 parts by mass (the amount in the toner: 17% by mass).

Example 22

Toner 22 was produced in the same manner as in Example 1 except that the amount of the [prepolymer 1] charged was changed to 22.5 parts by mass (the amount in the toner: 3% by mass).

Example 23

Toner 23 was produced in the same manner as in Example 1 except that the [monoester wax 1] was changed to the [monoester wax 4].

Example 24

Toner 24 was produced in the same manner as in Example 1 except that the [monoester wax 1] was changed to the [monoester wax 5].

Example 25

Preparation of Crystalline Polyester Dispersion Liquid

A stainless steel beaker was charged with 180 parts of the [crystalline polyester 3] and 585 parts of ion-exchanged water and heated to 95° C. in a hot-water bath.

At the time when the [crystalline polyester 3] was melted and the mixture became transparent, 1% by mass aqueous ammonia was added to the mixture so as to have a pH of 7.0 under stirring at 10,000 rpm using T.K. ROBOMIX (product of PRIMIX Corporation). Next, the resultant mixture was dispersed and emulsified while 20 parts by mass of an aqueous solution containing 0.8 parts by mass of an anionic surfactant (NEOGEN R-K, product of DAI-ICHI KOGYO SEIYAKU CO., LTD.) and 0.2 parts by mass of a nonionic emulsifier (EMULGEN 950, product of DAI-ICHI KOGYO SEIYAKU CO., LTD.) diluted in water was being added dropwise thereto, to thereby obtain [crystalline polyester dispersion liquid] containing crystalline polyester particles having a volume average particle diameter of 0.8 μm (solid content concentration: 11.9% by mass).

—Preparation of Non-Crystalline Polyester Dispersion Liquid—

[Non-crystalline polyester dispersion liquid] (solid content concentration: 12.3% by mass) was prepared in the same manner as in the preparation of the crystalline polyester dispersion liquid except that the [crystalline polyester 3] was changed to the [non-crystalline polyester 3].

—Preparation of Pigment Dispersion Liquid—

A container was charged with 20 parts by mass of carbon black (MA100S, product of Mitsubishi Chemical Corporation), 80 parts by mass of ion-exchanged water and 4.0 parts by mass of an anionic surfactant (NEOGEN R-K, product of DAI-ICHI KOGYO SEIYAKU CO., LTD.). The resultant mixture was treated for dispersing the pigment using a beads mill (ULTRA VISCO MILL, product of Aymex Co.) under the following conditions: liquid-feeding rate: 1 kg/h; disc circumferential speed: 6 m/sec; the amount of zirconia beads having a particle diameter of 0.3 mm packed: 80% by volume; pass time: 15, to thereby prepare [pigment dispersion liquid] containing pigment particles having a volume average particle diameter of 0.07 μm (solid content concentration: 19.8% by mass).

—Preparation of Wax Dispersion Liquid—

The [monoester wax 1] (20 parts by mass), 80 parts by mass of ion-exchanged water and 4 parts by mass of an anionic surfactant (NEOGEN R-K, product of DAI-ICHI KOGYO SEIYAKU CO., LTD.) were mixed together. While being stirred, the resultant mixture was increased in temperature to 95° C. and maintained for 1 hour, followed by cooling. Next, the obtained mixture was treated for dispersing the wax using a beads mill (ULTRA VISCO MILL, product of Aymex Co.) under the following conditions: liquid-feeding rate: 1 kg/h; disc circumferential speed: 6 m/sec the amount of zirconia beads having a particle diameter of 0.3 mm packed: 80% by volume; pass time: 25, to thereby prepare [wax dispersion liquid] containing wax particles having a volume average particle diameter of 0.15 μm (solid content concentration: 20.8% by mass).

—Preparation of Charge-Controlling Agent (CCA) Dispersion Liquid—

A container was charged with 5 parts by mass of a charge-controlling agent (CCA, BONTRON E-84, product of Orient Chemical Industries, Ltd.), 95 parts by mass of ion-exchanged water and 0.5 parts by mass of an anionic surfactant (NEOGEN R-K, product of DAI-ICHI KOGYO SEIYAKU CO., LTD.). The resultant mixture was treated for dispersing the charge-controlling agent using a beads mill (ULTRA VISCO MILL, product of Aymex Co.) under the following conditions: liquid-feeding rate: 1 kg/h; disc circumferential speed: 6 m/sec; the amount of zirconia beads having a particle diameter of 0.3 mm packed: 80% by volume; pass time: 5, to thereby prepare [charge-controlling agent (CCA) dispersion liquid] (solid content concentration: 4.8% by mass).

—Preparation of Toner—

The above-prepared pigment dispersion liquid: 35.4 parts by mass

The above-prepared charge-controlling agent (CCA) dispersion liquid: 20.8 parts by mass The above-prepared crystalline polyester dispersion liquid: 67.2 parts by mass The above-prepared non-crystalline polyester dispersion liquid: 634.1 parts by mass The above-prepared wax dispersion liquid: 28.8 parts by mass The above-listed dispersion liquids were mixed together and stirred using DISPER (product of IKA Co.) for 2 hours while the temperature being maintained at 25° C. Next, the obtained mixture was heated to 60° C. and the pH of the mixture was adjusted to 7.0 with ammonia. Furthermore, the resultant dispersion liquid was heated to 90° C. and maintained at this temperature for 6 hours, to thereby obtain a dispersion slurry.

The thus-obtained dispersion slurry was washed and dried in the same manner as in Example 1, to thereby produce toner 25.

Comparative Example 1

Toner 26 was produced in the same manner as in Example 1 except that the amounts of the materials were adjusted so that the amount of the [crystalline polyester 1] relative to 100 parts by mass of the [non-crystalline polyester 1] was 30 parts by mass (the amount in the toner: 10.9% by mass).

Comparative Example 2

Toner 27 was produced in the same manner as in Example 1 except that the amount of the [prepolymer 1] charged was changed to 205 parts by mass (the amount in the toner: 22% by mass).

Comparative Example 3

Toner 28 was produced in the same manner as in Example 1 except that the [crystalline polyester 1] was changed to the [crystalline polyester 4].

Comparative Example 4

Toner 29 was produced in the same manner as in Example 1 except that the [monoester wax 1] was changed to the [monoester wax 6].

Comparative Example 5

Toner 30 was produced in the same manner as in Example 1 except that the [monoester wax 1] was changed to the [monoester wax 7].

Comparative Example 6

Toner 31 was produced in the same manner as in Example 1 except that the [crystalline polyester 1] was changed to the [crystalline polyester 2] and that the [prepolymer 1] was changed to the [prepolymer 2].

Comparative Example 7

Toner 32 was produced in the same manner as in Example 1 except that the [crystalline polyester 1] was changed to the [crystalline polyester 5].

Comparative Example 8

Toner 33 was produced in the same manner as in Example 1 except that the [monoester wax 1] was changed to the [monoester wax 9].

Comparative Example 9

Toner 34 was produced in the same manner as in Example 1 except that the [monoester wax 1] was changed to the [monoester wax 10].

The following Tables 4-1, 4-2, 4-3 and 4-4 collectively present the compositions of the toners produced in Examples and Comparative Examples. Also, the toners and the releasing agents were measured for properties, and the results are presented in Tables 5-1 and 5-2.

TABLE 4-1

| | Non-crystalline polyester (Unmodified polyester) | | | | | |
|---|---|---|---|---|---|---|
| | Type | Amount | Mn | Mw | Tg | Acid value (mgKOH/g) |
| Ex. 1 | Unmodified polyester 1 | 100 parts by mass | 1,900 | 4,400 | 43° C. | 25 |
| Ex. 2 | Unmodified polyester 1 | 100 parts by mass | 1,900 | 4,400 | 43° C. | 25 |
| Ex. 3 | Unmodified polyester 1 | 100 parts by mass | 1,900 | 4,400 | 43° C. | 25 |
| Ex. 4 | Unmodified polyester 1 | 100 parts by mass | 1,900 | 4,400 | 43° C. | 25 |
| Ex. 5 | Unmodified polyester 1 | 100 parts by mass | 1,900 | 4,400 | 43° C. | 25 |
| Ex. 6 | Unmodified polyester 1 | 100 parts by mass | 1,900 | 4,400 | 43° C. | 25 |
| Ex. 7 | Unmodified polyester 1 | 100 parts by mass | 1,900 | 4,400 | 43° C. | 25 |
| Ex. 8 | Unmodified polyester 1 | 100 parts by mass | 1,900 | 4,400 | 43° C. | 25 |
| Ex. 9 | Unmodified polyester 1 | 100 parts by mass | 1,900 | 4,400 | 43° C. | 25 |
| Ex. 10 | Unmodified polyester 1 | 100 parts by mass | 1,900 | 4,400 | 43° C. | 25 |
| Ex. 11 | Unmodified polyester 1 | 100 parts by mass | 1,900 | 4,400 | 43° C. | 25 |
| Ex. 12 | Unmodified polyester 1 | 100 parts by mass | 1,900 | 4,400 | 43° C. | 25 |
| Ex. 13 | Unmodified polyester 1 | 100 parts by mass | 1,900 | 4,400 | 43° C. | 25 |
| Ex. 14 | Unmodified polyester 1 | 100 parts by mass | 1,900 | 4,400 | 43° C. | 25 |
| Ex. 15 | Unmodified polyester 1 | 100 parts by mass | 1,900 | 4,400 | 43° C. | 25 |
| Ex. 16 | Unmodified polyester 2 | 100 parts by mass | 1,300 | 3,400 | 32° C. | 28 |
| Ex. 17 | Unmodified polyester 3 | 100 parts by mass | 2,900 | 6,800 | 64° C. | 17 |
| Ex. 18 | Unmodified polyester 4 | 100 parts by mass | 1,300 | 5,600 | 49° C. | 23 |
| Ex. 19 | Unmodified polyester 1 | 100 parts by mass | 1,900 | 4,400 | 43° C. | 25 |
| Ex. 20 | Unmodified polyester 1 | 100 parts by mass | 1,900 | 4,400 | 43° C. | 25 |
| Ex. 21 | Unmodified polyester 1 | 100 parts by mass | 1,900 | 4,400 | 43° C. | 25 |
| Ex. 22 | Unmodified polyester 1 | 100 parts by mass | 1,900 | 4,400 | 43° C. | 25 |
| Ex. 23 | Unmodified polyester 1 | 100 parts by mass | 1,900 | 4,400 | 43° C. | 25 |
| Ex. 24 | Unmodified polyester 1 | 100 parts by mass | 1,900 | 4,400 | 43° C. | 25 |

TABLE 4-1-continued

| | Non-crystalline polyester (Unmodified polyester) | | | | | |
|---|---|---|---|---|---|---|
| | Type | Amount | Mn | Mw | Tg | Acid value (mgKOH/g) |
| Ex. 25 | Unmodified polyester 3 | 634.1 parts by mass | 2,900 | 6,800 | 64° C. | 17 |
| Comp. Ex. 1 | Unmodified polyester 1 | 100 parts by mass | 1,900 | 4,400 | 43° C. | 25 |
| Comp. Ex. 2 | Unmodified polyester 1 | 100 parts by mass | 1,900 | 4,400 | 43° C. | 25 |
| Comp. Ex. 3 | Unmodified polyester 1 | 100 parts by mass | 1,900 | 4,400 | 43° C. | 25 |
| Comp. Ex. 4 | Unmodified polyester 1 | 100 parts by mass | 1,900 | 4,400 | 43° C. | 25 |
| Comp. Ex. 5 | Unmodified polyester 1 | 100 parts by mass | 1,900 | 4,400 | 43° C. | 25 |
| Comp. Ex. 6 | Unmodified polyester 1 | 100 parts by mass | 1,900 | 4,400 | 43° C. | 25 |
| Comp. Ex. 7 | Unmodified polyester 1 | 100 parts by mass | 1,900 | 4,400 | 43° C. | 25 |
| Comp. Ex. 8 | Unmodified polyester 1 | 100 parts by mass | 1,900 | 4,400 | 43° C. | 25 |
| Comp. Ex. 9 | Unmodified polyester 1 | 100 parts by mass | 1,900 | 4,400 | 43° C. | 25 |

TABLE 4-2

| | Binder resin precursor (Prepolymer) | | |
|---|---|---|---|
| | Type | Amount (parts by mass) | Amount (% by mass) |
| Ex. 1 | Prepolymer 1 | 80.8 | 10 |
| Ex. 2 | Prepolymer 1 | 120 | 14 |
| Ex. 3 | Prepolymer 1 | 80.8 | 10 |
| Ex. 4 | Prepolymer 1 | 80.8 | 10 |
| Ex. 5 | Prepolymer 1 | 80.8 | 9.5 |
| Ex. 6 | Prepolymer 1 | 80.8 | 10.2 |
| Ex. 7 | Prepolymer 1 | 80.8 | 10 |
| Ex. 8 | Prepolymer 1 | 80.8 | 10 |
| Ex. 9 | Prepolymer 1 | 80.8 | 9.4 |
| Ex. 10 | Prepolymer 1 | 80.8 | 9.4 |
| Ex. 11 | Prepolymer 1 | 80.8 | 10.4 |
| Ex. 12 | Prepolymer 1 | 80.8 | 10 |
| Ex. 13 | Prepolymer 1 | 80.8 | 10 |
| Ex. 14 | Prepolymer 1 | 80.8 | 10 |
| Ex. 15 | Prepolymer 1 | 80.8 | 10 |
| Ex. 16 | Prepolymer 1 | 80.8 | 10 |
| Ex. 17 | Prepolymer 1 | 80.8 | 10 |
| Ex. 18 | Prepolymer 1 | 80.8 | 10 |
| Ex. 19 | Prepolymer 2 | 80.8 | 10 |
| Ex. 20 | Prepolymer 3 | 80.8 | 10 |
| Ex. 21 | Prepolymer 1 | 150 | 17 |
| Ex. 22 | Prepolymer 1 | 22.5 | 3 |
| Ex. 23 | Prepolymer 1 | 80.8 | 10 |
| Ex. 24 | Prepolymer 1 | 80.8 | 10 |
| Ex. 25 | — | — | — |
| Comp. Ex. 1 | Prepolymer 1 | 80.8 | 10 |
| Comp. Ex. 2 | Prepolymer 1 | 205 | 22 |
| Comp. Ex. 3 | Prepolymer 1 | 80.8 | 10 |
| Comp. Ex. 4 | Prepolymer 1 | 80.8 | 10 |
| Comp. Ex. 5 | Prepolymer 1 | 80.8 | 10 |
| Comp. Ex. 6 | Prepolymer 2 | 80.8 | 10 |
| Comp. Ex. 7 | Prepolymer 1 | 80.8 | 10 |
| Comp. Ex. 8 | Prepolymer 1 | 80.8 | 10 |
| Comp. Ex. 9 | Prepolymer 1 | 80.8 | 10 |

*In each toner, the amount of the prepolymer is the same as that of the modified polyester resin.

TABLE 4-3

| | Crystalline polyester resin | | | |
|---|---|---|---|---|
| | Type | Amount (parts by mass) | Amount (% by mass) | Melting point |
| Ex. 1 | Crystalline polyester 1 | 20 parts by mass | 7.5 | 79° C. |
| Ex. 2 | Crystalline polyester 1 | 20 parts by mass | 7.2 | 79° C. |
| Ex. 3 | Crystalline polyester 1 | 18 parts by mass | 6.8 | 79° C. |
| Ex. 4 | Crystalline polyester 1 | 4 parts by mass | 1.6 | 79° C. |
| Ex. 5 | Crystalline polyester 1 | 20 parts by mass | 7.3 | 79° C. |
| Ex. 6 | Crystalline polyester 1 | 20 parts by mass | 7.8 | 79° C. |
| Ex. 7 | Crystalline polyester 1 | 20 parts by mass | 7.5 | 79° C. |
| Ex. 8 | Crystalline polyester 1 | 20 parts by mass | 7.5 | 79° C. |
| Ex. 9 | Crystalline polyester 1 | 20 parts by mass | 7.1 | 79° C. |
| Ex. 10 | Crystalline polyester 1 | 20 parts by mass | 7.1 | 79° C. |
| Ex. 11 | Crystalline polyester 1 | 20 parts by mass | 8.0 | 79° C. |
| Ex. 12 | Crystalline polyester 2 | 20 parts by mass | 7.5 | 54° C. |
| Ex. 13 | Crystalline polyester 3 | 20 parts by mass | 7.5 | 119° C. |
| Ex. 14 | Crystalline polyester 1 | 23 parts by mass | 8.5 | 79° C. |
| Ex. 15 | Crystalline polyester 1 | 1.5 parts by mass | 0.6 | 79° C. |
| Ex. 16 | Crystalline polyester 1 | 20 parts by mass | 7.5 | 79° C. |
| Ex. 17 | Crystalline polyester 1 | 20 parts by mass | 7.5 | 79° C. |
| Ex. 18 | Crystalline polyester 1 | 20 parts by mass | 7.5 | 79° C. |
| Ex. 19 | Crystalline polyester 1 | 20 parts by mass | 7.5 | 79° C. |
| Ex. 20 | Crystalline polyester 1 | 20 parts by mass | 7.5 | 79° C. |
| Ex. 21 | Crystalline polyester 1 | 20 parts by mass | 6.9 | 79° C. |

TABLE 4-3-continued

| | Crystalline polyester resin | | | |
|---|---|---|---|---|
| | Type | Amount (parts by mass) | Amount (% by mass) | Melting point |
| Ex. 22 | Crystalline polyester 1 | 20 parts by mass | 8.1 | 79° C. |
| Ex. 23 | Crystalline polyester 1 | 20 parts by mass | 7.5 | 79° C. |
| Ex. 24 | Crystalline polyester 1 | 20 parts by mass | 7.5 | 79° C. |
| Ex. 25 | Crystalline polyester 3 | 67.2 parts by mass | 8.5 | 119° C. |
| Comp. Ex. 1 | Crystalline polyester 1 | 30 parts by mass | 10.9 | 79° C. |
| Comp. Ex. 2 | Crystalline polyester 1 | 20 parts by mass | 6.5 | 79° C. |
| Comp. Ex. 3 | Crystalline polyester 4 | 20 parts by mass | 7.5 | 142° C. |
| Comp. Ex. 4 | Crystalline polyester 1 | 20 parts by mass | 7.5 | 79° C. |
| Comp. Ex. 5 | Crystalline polyester 1 | 20 parts by mass | 7.5 | 79° C. |
| Comp. Ex. 6 | Crystalline polyester 1 | 20 parts by mass | 7.5 | 79° C. |
| Comp. Ex. 7 | Crystalline polyester 5 | 20 parts by mass | 7.5 | 54° C. |
| Comp. Ex. 8 | Crystalline polyester 1 | 20 parts by mass | 7.5 | 79° C. |
| Comp. Ex. 9 | Crystalline polyester 1 | 20 parts by mass | 7.5 | 79° C. |

TABLE 4-4

| | Ester wax | | | | |
|---|---|---|---|---|---|
| | Type | Amount (parts by mass) | Amount (% by mass) | Melting point | Percentage of ester compounds having 44 or more carbon atoms |
| Ex. 1 | Monoester wax 1 | 100 | 7.5 | 66° C. | 48% |
| Ex. 2 | Monoester wax 1 | 100 | 7.2 | 66° C. | 48% |
| Ex. 3 | Monoester wax 1 | 100 | 7.5 | 66° C. | 48% |
| Ex. 4 | Monoester wax 1 | 100 | 7.5 | 66° C. | 48% |

TABLE 4-4-continued

| | Ester wax | | | | |
|---|---|---|---|---|---|
| | Type | Amount (parts by mass) | Amount (% by mass) | Melting point | Percentage of ester compounds having 44 or more carbon atoms |
| Ex. 5 | Monoester wax 1 | 135 | 9.5 | 66° C. | 48% |
| Ex. 6 | Monoester wax 1 | 55 | 4.0 | 66° C. | 48% |
| Ex. 7 | Monoester wax 2 | 100 | 7.5 | 72° C. | 52% |
| Ex. 8 | Monoester wax 3 | 100 | 7.5 | 58° C. | 46% |
| Ex. 9 | Monoester wax 8 | 100 | 7.5 | 80° C. | 50% |
| Ex. 10 | Monoester wax 1 | 175 | 12 | 66° C. | 48% |
| Ex. 11 | Monoester wax 1 | 20 | 1.5 | 66° C. | 48% |
| Ex. 12 | Monoester wax 1 | 100 | 7.5 | 66° C. | 48% |
| Ex. 13 | Monoester wax 1 | 100 | 7.5 | 66° C. | 48% |
| Ex. 14 | Monoester wax 1 | 100 | 7.5 | 66° C. | 48% |
| Ex. 15 | Monoester wax 1 | 100 | 7.5 | 66° C. | 48% |
| Ex. 16 | Monoester wax 1 | 100 | 7.5 | 66° C. | 48% |
| Ex. 17 | Monoester wax 1 | 100 | 7.5 | 66° C. | 48% |
| Ex. 18 | Monoester wax 1 | 100 | 7.5 | 66° C. | 48% |
| Ex. 19 | Monoester wax 1 | 100 | 7.5 | 66° C. | 48% |
| Ex. 20 | Monoester wax 1 | 100 | 7.5 | 66° C. | 48% |
| Ex. 21 | Monoester wax 1 | 100 | 6.9 | 66° C. | 48% |
| Ex. 22 | Monoester wax 1 | 100 | 8.1 | 66° C. | 48% |
| Ex. 23 | Monoester wax 4 | 100 | 7.5 | 78° C. | 59% |
| Ex. 24 | Monoester wax 5 | 100 | 7.5 | 56° C. | 41% |
| Ex. 25 | Monoester wax 1 | 28.8 | 6.1 | 66° C. | 48% |
| Comp. Ex. 1 | Monoester wax 1 | 100 | 7.5 | 66° C. | 48% |
| Comp. Ex. 2 | Monoester wax 1 | 100 | 6.5 | 66° C. | 48% |
| Comp. Ex. 3 | Monoester wax 1 | 100 | 7.5 | 66° C. | 48% |
| Comp. Ex. 4 | Monoester wax 6 | 100 | 7.5 | 42° C. | 40% |
| Comp. Ex. 5 | Monoester wax 7 | 100 | 7.5 | 88° C. | 53% |
| Comp. Ex. 6 | Monoester wax 1 | 100 | 7.5 | 66° C. | 48% |
| Comp. Ex. 7 | Monoester wax 1 | 100 | 7.5 | 66° C. | 48% |
| Comp. Ex. 8 | Monoester wax 9 | 100 | 7.5 | 84° C. | 51% |
| Comp. Ex. 9 | Monoester wax 10 | 100 | 7.5 | 51° C. | 46% |

TABLE 5-1

| | Storage modulus G1 (Pa · s) at 80° C. in the heating | Loss modulus G2 (Pa · s) at 80° C. in the heating | G2/G1 | Storage modulus G3 (Pa · s) at 80° C. in the cooling | Loss modulus G4 (Pa · s) at 80° C. in the cooling | Storage modulus G5 (Pa · s) at 120° C. in the heating |
|---|---|---|---|---|---|---|
| Ex. 1 | 38,300 | 43,540 | 1.14 | 32,500 | 33,600 | 4,900 |
| Ex. 2 | 45,460 | 49,500 | 1.09 | 39,300 | 36,600 | 5,400 |
| Ex. 3 | 32,400 | 38,990 | 1.20 | 27,100 | 29,000 | 4,260 |
| Ex. 4 | 42,500 | 49,300 | 1.16 | 35,500 | 36,800 | 5,700 |
| Ex. 5 | 37,250 | 42,100 | 1.13 | 31,720 | 31,700 | 4,810 |
| Ex. 6 | 38,600 | 44,110 | 1.14 | 32,410 | 32,900 | 4,900 |
| Ex. 7 | 40,610 | 47,100 | 1.16 | 34,010 | 35,600 | 5,050 |
| Ex. 8 | 34,600 | 40,400 | 1.17 | 29,300 | 30,800 | 4,900 |
| Ex. 9 | 41,020 | 45,500 | 1.11 | 34,500 | 34,200 | 2,500 |
| Ex. 10 | 34,300 | 39,900 | 1.16 | 27,440 | 30,640 | 4,800 |
| Ex. 11 | 39,100 | 44,070 | 1.13 | 31,600 | 32,100 | 4,890 |
| Ex. 12 | 26,900 | 35,100 | 1.30 | 19,900 | 23,900 | 3,600 |
| Ex. 13 | 47,770 | 49,980 | 1.05 | 39,510 | 37,340 | 5,600 |
| Ex. 14 | 24,200 | 31,900 | 1.32 | 17,900 | 22,110 | 2,700 |
| Ex. 15 | 47,100 | 52,300 | 1.11 | 36,740 | 36,700 | 6,810 |
| Ex. 16 | 35,110 | 41,420 | 1.18 | 27,730 | 30,100 | 4,100 |
| Ex. 17 | 48,200 | 53,200 | 1.10 | 36,500 | 38,900 | 5,600 |
| Ex. 18 | 47,310 | 55,200 | 1.17 | 35,020 | 39,400 | 5,200 |
| Ex. 19 | 31,200 | 37,600 | 1.21 | 23,400 | 27,300 | 4,100 |

TABLE 5-1-continued

| | Storage modulus G1 (Pa · s) at 80° C. in the heating | Loss modulus G2 (Pa · s) at 80° C. in the heating | G2/G1 | Storage modulus G3 (Pa · s) at 80° C. in the cooling | Loss modulus G4 (Pa · s) at 80° C. in the cooling | Storage modulus G5 (Pa · s) at 120° C. in the heating |
|---|---|---|---|---|---|---|
| Ex. 20 | 47,990 | 50,810 | 1.06 | 40,100 | 37,300 | 6,600 |
| Ex. 21 | 49,200 | 51,660 | 1.05 | 41,330 | 37,320 | 6,200 |
| Ex. 22 | 29,480 | 35,280 | 1.20 | 23,440 | 26,280 | 4,030 |
| Ex. 23 | 39,400 | 45,700 | 1.16 | 31,920 | 34,430 | 5,100 |
| Ex. 24 | 33,910 | 39,670 | 1.17 | 26,790 | 29,700 | 4,500 |
| Ex. 25 | 24,110 | 32,300 | 1.34 | 17,100 | 22,500 | 2,500 |
| Comp. Ex. 1 | 21,350 | 28,540 | 1.34 | 15,760 | 22,600 | 2,400 |
| Comp. Ex. 2 | 64,200 | 66,100 | 1.03 | 54,570 | 47,220 | 7,700 |
| Comp. Ex. 3 | 18,500 | 23,490 | 1.27 | 13,130 | 19,010 | 3,200 |
| Comp. Ex. 4 | 36,300 | 42,100 | 1.16 | 28,320 | 30,780 | 5,450 |
| Comp. Ex. 5 | 38,940 | 44,700 | 1.15 | 31,500 | 32,900 | 5,200 |
| Comp. Ex. 6 | 17,100 | 23,400 | 1.37 | 11,800 | 19,500 | 1,900 |
| Comp. Ex. 7 | 16,200 | 22,300 | 1.38 | 10,900 | 18,900 | 1,700 |
| Comp. Ex. 8 | 37,210 | 43,050 | 1.16 | 30,050 | 32,900 | 5,100 |
| Comp. Ex. 9 | 36,950 | 43,050 | 1.17 | 29,470 | 32,900 | 5,060 |

TABLE 5-2

| | G3/G1 | G4/G2 | (G4/G2)/(G3/G1) | Melting point of the releasing agent (° C.) | Percentage (%) of ester compounds having 44 or more carbon atoms in ester wax |
|---|---|---|---|---|---|
| Ex. 1 | 0.85 | 0.77 | 0.91 | 66 | 48 |
| Ex. 2 | 0.86 | 0.74 | 0.86 | 66 | 48 |
| Ex. 3 | 0.84 | 0.74 | 0.89 | 66 | 48 |
| Ex. 4 | 0.84 | 0.75 | 0.89 | 66 | 48 |
| Ex. 5 | 0.85 | 0.75 | 0.88 | 66 | 48 |
| Ex. 6 | 0.84 | 0.75 | 0.89 | 66 | 48 |
| Ex. 7 | 0.84 | 0.76 | 0.90 | 72 | 52 |
| Ex. 8 | 0.85 | 0.76 | 0.90 | 58 | 46 |
| Ex. 9 | 0.84 | 0.75 | 0.89 | 80 | 50 |
| Ex. 10 | 0.80 | 0.77 | 0.96 | 66 | 48 |
| Ex. 11 | 0.81 | 0.73 | 0.90 | 66 | 48 |
| Ex. 12 | 0.74 | 0.68 | 0.92 | 66 | 48 |
| Ex. 13 | 0.83 | 0.75 | 0.90 | 66 | 48 |
| Ex. 14 | 0.74 | 0.69 | 0.94 | 66 | 48 |
| Ex. 15 | 0.78 | 0.70 | 0.90 | 66 | 48 |
| Ex. 16 | 0.79 | 0.73 | 0.92 | 66 | 48 |
| Ex. 17 | 0.76 | 0.73 | 0.97 | 66 | 48 |
| Ex. 18 | 0.74 | 0.71 | 0.96 | 66 | 48 |
| Ex. 19 | 0.75 | 0.73 | 0.97 | 66 | 48 |
| Ex. 20 | 0.84 | 0.73 | 0.88 | 66 | 48 |
| Ex. 21 | 0.84 | 0.72 | 0.86 | 66 | 48 |
| Ex. 22 | 0.80 | 0.74 | 0.94 | 66 | 48 |
| Ex. 23 | 0.81 | 0.75 | 0.93 | 76 | 59 |
| Ex. 24 | 0.79 | 0.75 | 0.95 | 56 | 41 |
| Ex. 25 | 0.71 | 0.70 | 0.98 | 66 | 48 |
| Comp. Ex. 1 | 0.74 | 0.79 | 1.07 | 66 | 48 |
| Comp. Ex. 2 | 0.85 | 0.71 | 0.84 | 66 | 48 |
| Comp. Ex. 3 | 0.71 | 0.81 | 1.14 | 66 | 48 |
| Comp. Ex. 4 | 0.78 | 0.73 | 0.94 | 42 | 40 |
| Comp. Ex. 5 | 0.81 | 0.74 | 0.91 | 88 | 53 |
| Comp. Ex. 6 | 0.69 | 0.83 | 1.21 | 66 | 48 |

TABLE 5-2-continued

| | G3/G1 | G4/G2 | (G4/G2)/(G3/G1) | Melting point of the releasing agent (° C.) | Percentage (%) of ester compounds having 44 or more carbon atoms in ester wax |
|---|---|---|---|---|---|
| Comp. Ex. 7 | 0.67 | 0.85 | 1.26 | 66 | 48 |
| Comp. Ex. 8 | 0.81 | 0.76 | 0.95 | 84 | 51 |
| Comp. Ex. 9 | 0.80 | 0.76 | 0.96 | 51 | 46 |

<Production Example of Carrier>

A silicone resin (organostraight silicone, product of Shin-Etsu Chemical Co., Ltd.) (100 parts by mass), γ-(2-aminoethyl)aminopropyltrimethoxysilane (5 parts by mass) and carbon black (10 parts by mass) were added to toluene (100 parts by mass), and these materials were dispersed using a homomixer for 20 min, to thereby prepare a resin layer-coating liquid. Subsequently, using a fluidized-bed coater, the resin layer-coating liquid was coated on the surfaces of spherical magnetite particles (1,000 parts by mass) having an average particle diameter of 50 μm, whereby a carrier was prepared.

<Production of Developer>

Using a ball mill, each toner (5 parts by mass) and the above-prepared carrier (95 parts by mass) were mixed together to produce developers. The obtained developers were evaluated for properties in the following manner. The results are presented in Tables 6-1 and 6-2.

<Evaluation of Fixing Property>

Evaluation of fixing property was performed using an image forming apparatus (IMAGIO 6000RC, product of Ricoh Company, Ltd.) which could print out sixty A4-size paper sheets per minute and was modified so that the temperature of its fixing roller could be variable. This image forming apparatus was adjusted so that solid images were formed on transfer paper sheets of plain paper and thick paper (type 6200 and copy paper sheet <135>, these products are of Ricoh Company, Ltd.) where each of the solid image carried the toner at 1.0 mg/cm$^2$±0.1 mg/cm$^2$. Then, the plain paper was used to measure a hot offset temperature which is a temperature at which no offset occurred. Meanwhile, the thick paper was used to measure a minimum fixing temperature.

The hot offset temperature was defined as a temperature at which the following phenomenon was visually confirmed. Specifically, when a 3 cm×8 cm solid image was formed on a 3-cm region of a paper sheet from the top thereof, followed by fixing, the color of the formed solid image was transferred to the lower blank portion of the paper sheet. The hot offset property of each toner was evaluated according to the following criteria.

[Evaluation Criteria of Hot Offset Temperature]

A: 170° C.≤Hot offset temperature

B: 165° C.≤Hot offset temperature<170° C.

C: 160° C.≤Hot offset temperature<165° C.

D: Hot offset temperature<160° C.

The minimum fixing temperature was defined as a temperature of the fixing roller at which the following phenomenon was confirmed. Specifically, when the fixed image was rubbed five times with white cotton (JIS L0803 Cotton No. 3), the residual rate of the image density was 70% or higher; i.e., the percentage of the image density after the rubbing relative to the image density before the rubbing. The low-temperature fixing property of each toner was evaluated according to the following criteria.

[Evaluation Criteria of Minimum Fixing Temperature]

A: Minimum fixing temperature<120° C.

B: 120° C.≤Minimum fixing temperature<125° C.

C: 125° C.≤Minimum fixing temperature<130° C.

D: 130° C.≤Minimum fixing temperature

<Evaluation of Heat Resistance Storage Stability>

After stored at 50° C. for 8 hours, each toner was screened with a 42-mesh sieve for 2 min, and the residual rate of the toner remaining on the sieve was measured. The heat resistance storage stability of each toner was evaluated according to the following criteria. Notably, the smaller toner's residual rate means better heat resistance storage stability.

[Evaluation Criteria]

A: Toner's residual rate<10%

B: 10%≤Toner's residual rate<20%

C: 20%≤Toner's residual rate<40%

D: 40%≤Toner's residual rate

<Evaluation of Sticking Between Discharged Paper Sheets>

Evaluation of sticking between discharged paper sheets was performed using an image forming apparatus (IMAGIO 6000RC, product of Ricoh Company, Ltd.) which could print out sixty A4-size paper sheets per minute and was modified so that the temperature of its fixing roller could be variable. Specifically, 240 sheets of white paper (C2S 12 pt (265) LT Kromekote paper, product of Kromekote Co.), which is thick transfer paper, were continuously fed to this image forming apparatus. Subsequently, the image forming apparatus was adjusted so that solid images each carrying the toner at 1.0 mg/cm$^2$±0.1 mg/cm$^2$ were formed, and 20 sheets of the paper were continuously fed thereto such that both sides of each paper sheet was printed and fixed. Thereafter, 240 sheets of the white paper were continuously fed to the image forming apparatus and stacked on top of one another on a finisher (SR4040, product of Ricoh Company, Ltd.) and the paper sheets were left to stand still for 3 hours with the paper sheets being stacked on top of one another. After being left to stand still, the fixed images of the 250th and the 251st paper sheets were observed. A thermocouple was sandwiched between the 250th and the 251st paper sheets so that the thermocouple was at the center thereof, to thereby measure a temperature between the paper sheets at which the image was peeled off. The sticking between discharged paper sheets of each toner was evaluated according to the following criteria. Notably, the higher temperature between the paper sheets at which the image was peeled off means less occurrence of sticking between paper sheets.

[Evaluation Criteria]

A: 60° C.≤The temperature between the paper sheets at which the image was peeled off B: 55° C.≤The temperature between the paper sheets at which the image was peeled off<60° C.

C: 50° C.≤The temperature between the paper sheets at which the image was peeled off<55° C.

D: The temperature between the paper sheets at which the image was peeled off<50° C.

<Overall Evaluation>

Overall evaluations were performed according to the following criteria.

A: There were all A in the evaluation items.

B: There were one or more B and two or less C in the evaluation items.

C: There were three or more C or one or more D in the evaluation items.

TABLE 6-1

| | Low-temperature fixing property | Hot offset property | Heat resistance storage stability | Sticking between discharged paper sheets | Overall evaluation |
|---|---|---|---|---|---|
| Ex. 1 | A | A | A | A | A |
| Ex. 2 | A | A | A | A | A |
| Ex. 3 | A | A | A | A | A |
| Ex. 4 | A | A | A | A | A |
| Ex. 5 | A | A | A | A | A |
| Ex. 6 | A | A | A | A | A |
| Ex. 7 | A | A | A | A | A |
| Ex. 8 | A | A | A | A | A |
| Ex. 9 | A | A | A | A | A |
| Ex. 10 | A | A | B | A | B |
| Ex. 11 | B | B | A | B | B |
| Ex. 12 | A | B | B | B | B |
| Ex. 13 | B | A | A | A | B |
| Ex. 14 | A | B | B | B | B |
| Ex. 15 | B | A | A | A | B |
| Ex. 16 | A | A | B | B | B |
| Ex. 17 | B | A | A | A | B |
| Ex. 18 | B | A | B | A | B |
| Ex. 19 | A | B | B | B | B |
| Ex. 20 | B | A | A | A | B |
| Ex. 21 | B | A | A | A | B |
| Ex. 22 | A | B | B | B | B |
| Ex. 23 | B | A | A | A | B |
| Ex. 24 | A | B | B | B | B |
| Ex. 25 | B | B | B | B | B |

TABLE 6-2

| | Low-temperature fixing property | Hot offset property | Heat resistance storage stability | Sticking between discharged paper sheets | Overall evaluation |
|---|---|---|---|---|---|
| Comp. Ex. 1 | A | D | D | D | C |
| Comp. Ex. 2 | D | A | A | A | C |
| Comp. Ex. 3 | A | D | C | D | C |
| Comp. Ex. 4 | B | B | C | D | C |
| Comp. Ex. 5 | D | B | B | A | C |

TABLE 6-2-continued

| | Low-temperature fixing property | Hot offset property | Heat resistance storage stability | Sticking between discharged paper sheets | Overall evaluation |
|---|---|---|---|---|---|
| Comp. Ex. 6 | A | D | D | D | C |
| Comp. Ex. 7 | A | D | D | D | C |
| Comp. Ex. 8 | D | B | B | A | C |
| Comp. Ex. 9 | B | B | C | D | C |

As is clear from Table 4-1, 4-2, 4-3, 4-4, 5-1, 5-2, 6-1 and 6-2, the toners of Examples 1 to 25 were superior to those of Comparative Examples 1 to 9 in fixing property, releasing property, heat resistance storage stability and anti-sticking between discharged paper sheets.

Aspects of the present invention are as follows.

<1> A toner including:

a binder resin containing a non-crystalline resin and a crystalline resin;

a colorant; and, a releasing agent, wherein the releasing agent has a melting point of 55° C. to 80° C., and wherein the toner satisfies the following Expressions 1 and 2:

$$20{,}000\ \text{Pa·s} \leq G1 \leq 50{,}000\ \text{Pa·s; and} \quad \text{(Expression 1)}$$

$$(G4/G2)/(G3/G1) \leq 1.00, \quad \text{(Expression 2)}$$

where G1 is a storage modulus, G2 is a loss modulus, G3 is a storage modulus and G4 is a loss modulus, and the storage modulus G1 and the loss modulus G2 are measured at 80° C. when the toner is heated from 70° C. to 150° C. and the storage modulus G3 and the loss modulus G4 are measured at 80° C. when the toner heated to 150° C. is cooled to 70° C.

<2> The toner according to <1>, wherein the toner satisfies the following Expression 1a:

$$30{,}000\ \text{Pa·s} \leq G1 \leq 46{,}000\ \text{Pa·s}. \quad \text{(Expression 1a)}$$

<3> The toner according to <1> or <2>, wherein the toner satisfies the following Expression 3:

$$1.00 \leq G2/G1 \leq 1.30. \quad \text{(Expression 3)}$$

<4> The toner according to any one of <1> to <3>, wherein the toner satisfies the following Expression 4:

$$0.80 \leq G3/G1. \quad \text{(Expression 4)}$$

<5> The toner according to any one of <1> to <4>, wherein the crystalline resin in the binder resin contains a crystalline polyester resin, and the non-crystalline resin in the binder resin contains an unmodified polyester resin and a modified polyester resin, wherein the modified polyester resin is contained in the toner in an amount of 1% by mass to 20% by mass, and wherein the crystalline polyester resin is contained in the toner in an amount of 0.1% by mass to 10% by mass.

<6> The toner according to any one of <1> to <5>, wherein the releasing agent is an ester wax.

<7> The toner according to <6>, wherein the ester wax contains ester compounds having 44 or more carbon atoms in an amount of 45% to 55%.

<8> The toner according to any one of <1> to <7>, wherein the toner is produced by: dissolving or dispersing, in an organic solvent, the binder resin containing the non-crystalline resin and the crystalline resin, an active hydrogen group-containing compound, a binder resin precursor containing a site reactive with the active hydrogen group-containing compound, the colorant and the releasing agent, to thereby prepare a solution or dispersion liquid; emulsifying the solution or dispersion liquid in an aqueous medium, to thereby prepare an emulsion; allowing the binder resin precursor and the active hydrogen group-containing compound to react in the emulsion; and removing the organic solvent.

<9> A developer including:

the toner according to any one of <1> to <8>.

<10> An image forming apparatus including:

a latent electrostatic image bearing member;

a charging unit configured to charge a surface of the latent electrostatic image bearing member;

a light-exposing unit configured to expose the charged surface of the latent electrostatic image bearing member to light, to thereby form a latent electrostatic image;

a developing unit configured to develop the latent electrostatic image with a toner, to thereby form a visible image;

a transfer unit configured to transfer the visible image onto a recording medium; and a fixing unit configured to fix the visible image transferred onto the recording medium, wherein the image forming apparatus can form an image on 60 or more A4-size recording media per minute, and wherein the toner is the toner according to any one of <1> to <8>.

This application claims priority to Japanese application No. 2012-018256, filed on Jan. 31, 2012, and incorporated herein by reference.

What is claimed is:

1. A toner comprising:

a binder resin containing a non-crystalline resin and a crystalline resin;

a colorant; and, a releasing agent, wherein the releasing agent is an ester wax and has a melting point of 55° C. to 80° C., and wherein the toner satisfies the following Expressions 1 and 2:

$$20{,}000\ \text{Pa·s} \leq G1 \leq 50{,}000\ \text{Pa·s; and} \quad \text{(Expression 1)}$$

$$(G4/G2)/(G3/G1) \leq 1.00, \quad \text{(Expression 2)}$$

where G1 is a storage modulus, G2 is a loss modulus, G3 is a storage modulus and G4 is a loss modulus, and the storage modulus G1 and the loss modulus G2 are measured at 80° C. when the toner is heated from 70° C. to 150° C. and the storage modulus G3 and the loss modulus G4 are measured at 80° C. when the toner heated to 150° C. is cooled to 70° C.

wherein the crystalline resin in the binder resin comprises a crystalline polyester resin, and the non-crystalline resin in the binder resin comprises an unmodified polyester resin and a modified polyester resin, the modified polyester resin is contained in the toner in an amount of 1% by mass to 20% by mass of the toner, the crystalline polyester resin is contained in the toner in an amount of 0.1% by mass to 10% by mass of the toner, and the ester wax comprises ester compounds having 44 or more carbon atoms in an amount of 45% to 48%, based on the total amount of the ester wax.

2. The toner according to claim 1, wherein the toner satisfies the following Expression 1a:

$$30{,}000\ \text{Pa·s} \leq G1 \leq 46{,}000\ \text{Pa·s}. \quad \text{(Expression 1a)}$$

3. The toner according to claim 1,
wherein the toner satisfies the following Expression 3:

$$1.00 \leq G2/G1 \leq 1.30. \quad \text{(Expression 3)}$$

4. The toner according to claim 1,
wherein the toner satisfies the following Expression 4:

$$0.80 \leq G3/G1. \quad \text{(Expression 4)}$$

5. The toner according to claim 1,
wherein the toner is produced by: dissolving or dispersing, in an organic solvent, the binder resin containing the non-crystalline resin and the crystalline resin, an active hydrogen group-containing compound, a binder resin precursor containing a site reactive with the active hydrogen group-containing compound, the colorant and the releasing agent, to thereby prepare a solution or dispersion liquid; emulsifying the solution or dispersion liquid in an aqueous medium, to thereby prepare an emulsion; allowing the binder resin precursor and the active hydrogen group-containing compound to react in the emulsion; and removing the organic solvent.

6. A developer comprising:
a toner,
wherein the toner comprises:
a binder resin containing a non-crystalline resin and a crystalline resin;
a colorant; and,
a releasing agent,
wherein the releasing agent is an ester wax and has a melting point of 55° C. to 80° C., and
wherein the toner satisfies the following Expressions 1 and 2:

$$20{,}000\ \text{Pa·s} \leq G1 \leq 5\ 50{,}000\ \text{Pa·s; and} \quad \text{(Expression 1)}$$

$$(G4/G2)/(G3/G1) \leq 1.00, \quad \text{(Expression 2)}$$

where G1 is a storage modulus, G2 is a loss modulus, G3 is a storage modulus and G4 is a loss modulus, and the storage modulus G1 and the loss modulus G2 are measured at 80° C. when the toner is heated from 70° C. to 150° C. and the storage modulus G3 and the loss modulus G4 are measured at 80° C. when the toner heated to 150° C. is cooled to 70° C. wherein
the crystalline resin in the binder resin comprises a crystalline polyester resin, and the non-crystalline resin in the binder resin comprises an unmodified polyester resin and a modified polyester resin,
the modified polyester resin is contained in the toner in an amount of 1% by mass to 20% by mass of the toner,
the crystalline polyester resin is contained in the toner in an amount of 0.1% by mass to 10% by mass of the toner, and
the ester wax comprises ester compounds having 44 or more carbon atoms in an amount of 45% to 48%, based on the total amount of the ester wax.

* * * * *